US012796879B2

(12) United States Patent
Cheng et al.

(10) Patent No.: US 12,796,879 B2
(45) Date of Patent: Nov. 17, 2026

(54) DETACHABLE STRUCTURE AND SELF-MOVING ROBOT

(71) Applicant: Beijing Roborock Technology Co., Ltd., Beijing (CN)

(72) Inventors: Pan Cheng, Beijing (CN); Zhimin Yang, Beijing (CN); Chuanlin Duan, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 684 days.

(21) Appl. No.: 18/026,769

(22) PCT Filed: Feb. 2, 2021

(86) PCT No.: PCT/CN2021/074938
§ 371 (c)(1),
(2) Date: Mar. 16, 2023

(87) PCT Pub. No.: WO2022/057195
PCT Pub. Date: Mar. 24, 2022

(65) Prior Publication Data

US 2023/0337885 A1 Oct. 26, 2023

(30) Foreign Application Priority Data

Sep. 17, 2020 (CN) ..... 202010980229.1
Sep. 17, 2020 (CN) ..... 202010982307.1
Sep. 17, 2020 (CN) ..... 202010982320.7

(51) Int. Cl.
*A47L 11/292* (2006.01)
*A47L 11/29* (2006.01)
*A47L 11/40* (2006.01)

(52) U.S. Cl.
CPC ..... *A47L 11/292* (2013.01); *A47L 11/29* (2013.01); *A47L 11/4016* (2013.01);
(Continued)

(58) Field of Classification Search
CPC .... A47L 11/29; A47L 11/292; A47L 11/4016; A47L 11/4036; A47L 11/408; A47L 11/4083; A47L 11/4055; A47L 11/4058
See application file for complete search history.

(56) References Cited

U.S. PATENT DOCUMENTS 7,320,149 B1 1/2008 Huffman et al.
7,328,477 B1 * 2/2008 Aiyar ..... A47L 13/20 15/228
(Continued)

FOREIGN PATENT DOCUMENTS

CN 101238965 A 8/2008
CN 201119841 Y * 9/2008
(Continued)

OTHER PUBLICATIONS

CN2020109802291—Decision of Rejection with English Translation mailed Aug. 19, 2025.
(Continued)

*Primary Examiner* — Shay Karls
(74) *Attorney, Agent, or Firm* — Thomas Horstemeyer, LLP

(57) ABSTRACT

A detachable structure and a self-moving robot are provided. The detachable structure is provided in a self-moving robot including a wet cleaning apparatus. The wet cleaning apparatus includes a housing and a cleaning assembly disposed in the housing, and the detachable structure includes: a pressure plate having a connection end and a movable end. The movable end is adjustably clamped to the housing. When the movable end and the housing are in a clamped state, the movable end blocks a partial structure of the cleaning assembly such that the cleaning assembly abuts
(Continued)

against the housing; and when the movable end and the housing are in a non-clamped state, the cleaning assembly is removable from the housing.

18 Claims, 9 Drawing Sheets

(52) U.S. Cl.
CPC ..... *A47L 11/4036* (2013.01); *A47L 11/4063* (2013.01); *A47L 11/4066* (2013.01); *A47L 11/4069* (2013.01); *A47L 11/408* (2013.01); *A47L 11/4083* (2013.01); *A47L 11/4088* (2013.01); *A47L 2201/00* (2013.01); *A47L 2201/04* (2013.01)

(56) References Cited

U.S. PATENT DOCUMENTS

| | | | | |
|---|---|---|---|---|
| 2002/0152569 | A1 | 10/2002 | Zorzo | |
| 2011/0162157 | A1 | 7/2011 | Dooley et al. | |
| 2014/0130289 | A1* | 5/2014 | Hyun | A47L 11/185 15/319 |
| 2014/0259475 | A1 | 9/2014 | Doughty | |
| 2016/0259336 | A1 | 9/2016 | Lee et al. | |
| 2019/0142237 | A1 | 5/2019 | Isenberg et al. | |
| 2019/0216285 | A1 | 7/2019 | Jang et al. | |
| 2019/0223681 | A1 | 7/2019 | Jang et al. | |
| 2019/0290089 | A1 | 9/2019 | Johnson et al. | |

FOREIGN PATENT DOCUMENTS

| | | | | |
|---|---|---|---|---|
| CN | 103799925 | A | 5/2014 | |
| CN | 204105899 | U | 1/2015 | |
| CN | 104856613 | A | 8/2015 | |
| CN | 105342528 | A | 2/2016 | |
| CN | 205054041 | U | 3/2016 | |
| CN | 105455734 | A | 4/2016 | |
| CN | 105455747 | A | 4/2016 | |
| CN | 106166050 | A | 11/2016 | |
| CN | 107485341 | A | 12/2017 | |
| CN | 107595213 | A | 1/2018 | |
| CN | 207029358 | U | 2/2018 | |
| CN | 107791232 | A | 3/2018 | |
| CN | 207870851 | U | 9/2018 | |
| CN | 108903829 | A | 11/2018 | |
| CN | 208822675 | U | 11/2018 | |
| CN | 108968833 | A | 12/2018 | |
| CN | 208176532 | U | 12/2018 | |
| CN | 208598297 | U | 3/2019 | |
| CN | 109732558 | A | 5/2019 | |
| CN | 208988721 | U | 6/2019 | |
| CN | 209059055 | U | 7/2019 | |
| CN | 213030588 | U | 4/2021 | |
| CN | 214104326 | U | 9/2021 | |
| CN | 215016839 | U | 12/2021 | |
| EP | 2561784 | A2 | 2/2013 | |
| KR | 20040013380 | A | 2/2004 | |
| KR | 100779195 | B1 | 11/2007 | |
| KR | 20130032490 | A | 4/2013 | |
| KR | 20140096591 | A | 8/2014 | |
| KR | 20140096597 | A | 8/2014 | |
| TW | 557581 | U | 4/2018 | |
| WO | WO-2019233493 | A1 * | 12/2019 | H02J 7/80 |

OTHER PUBLICATIONS

CN2020109823207—2nd Office Action with English Translation mailed Jul. 10, 2025.
CN2020109823071—Decision of Rejection with English Translation.
International Search Report for PCT Patent Application No. PCT/CN2021/074938 mailed Jun. 16, 2021.
Taiwanese Office Action dated Nov. 9, 2022.
EP21868035.3—Extended European Search Report.
TW112148853—Notice of Allowance.
Notice of Allowance mailed on Jan. 9, 2026 for Chinese Patent Application No. 202010980229.1.
Extended European Search Report for Application No. 26169488.9.

* cited by examiner

DETACHABLE STRUCTURE AND SELF-MOVING ROBOT

CROSS-REFERENCE TO RELATED APPLICATIONS

The present disclosure is a US national phase application under 35 U.S.C. § 371 of a PCT application number PCT/CN2021/074938, which claims priority to Chinese applications No. 202010982307.1, 202010982320.7, and 202010980229.1 filed on Sep. 17, 2020, which are incorporated herein by reference in their entireties.

TECHNICAL FIELD

The present disclosure relates to the field of cleaning device technologies, and in particular, to a detachable structure, a drive wheel structure, and a self-moving robot.

BACKGROUND

Currently, self-moving robots mainly include a sweeping robot and a mopping robot. Functions of the self-moving robot and the mopping robot are relatively single, and the mopping effect and efficiency are greatly reduced.

SUMMARY

The present disclosure provides a detachable structure, provided in a self-moving robot, wherein the self-moving robot includes a wet cleaning apparatus, the wet cleaning apparatus includes a housing and a cleaning assembly disposed in the housing, and the detachable structure includes: a pressure plate, having a connection end and a movable end, the movable end being adjustably clamped to the housing. when the movable end and the housing are in a clamped state, the movable end blocks a partial structure of the cleaning assembly such that the cleaning assembly abuts against the housing; and when the movable end and the housing are in a non-clamped state, the cleaning assembly is removable from the housing.

The present disclosure further provides a self-moving robot, the self-moving robot includes a detachable structure, wherein the detachable structure is provided in a self-moving robot, wherein the self-moving robot includes a wet cleaning apparatus, the wet cleaning apparatus includes a housing and a cleaning assembly disposed in the housing, and the detachable structure includes: a pressure plate, having a connection end and a movable end, the movable end being adjustably clamped to the housing, when the movable end and the housing are in a clamped state, the movable end blocks a partial structure of the cleaning assembly such that the cleaning assembly abuts against the housing; and when the movable end and the housing are in a non-clamped state, the cleaning assembly is removable from the housing.

Figure 1:
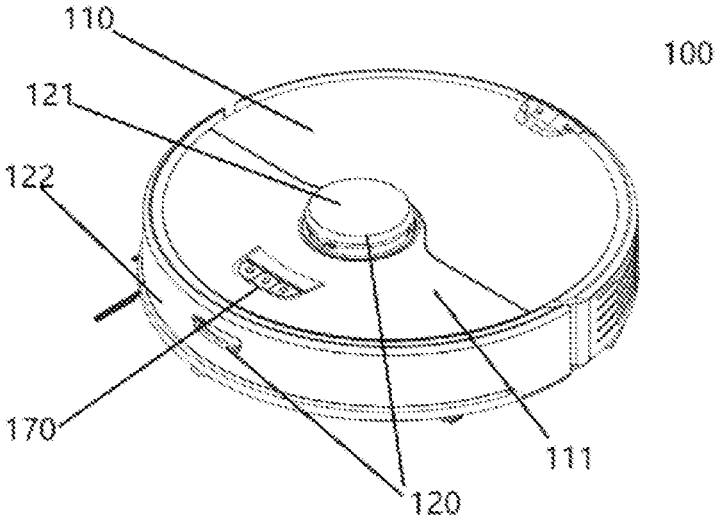
FIG. 1 is a perspective view of a self-moving robot according to an embodiment of the present disclosure.

DESCRIPTION OF REFERENCE SIGNS IS AS FOLLOWS:

100. Robot;
110. Rack;
120. Sensing system;
121. Position determining apparatus;
122. Buffer;
123. Cliff sensor;
130. Control system;
140. Drive system;
141. Drive wheel module;
1411. Body portion;
14111. Accommodation part;
14112. Groove;
1412. Drive wheel;
1413. Drive motor;
142. Driven wheel;
143. Elastic element;
150. Dry cleaning apparatus;
151. Cleaning system;
152. Dust box;
153. Filter screen;
154. Dust suction port;
155. Air outlet;
156. Fan;
160. Energy system;
170. Human-computer interaction system;

171. Tail light;
200. Wet cleaning apparatus;
201. Housing;
210. Cleaning head;
211. Elastic support structure;
212. Camshaft;
213. Slide rail;
220. Water supply mechanism;
221. Clean water pump;
222. Clean water pump pipe;
230. Water return mechanism;
231. Water suction roller;
232. Recovery rod;
233. Dirty water pump;
234. Dirty water pump pipe;
235. Water suction material;
236. Scraping strip;
237. Recovery groove;
238. Worm structure;
239. Sludge box;
240. Water tank;
241. Clean water tank;
242. Dirty water tank;
243. Water level detection apparatus;
250. Lifting module;
260. Power module;
261. Power transmission apparatus;
262. Motor;
270. Guide wheel;
280. Pressure plate;
281. Connection end; and
282. Movable end.

DESCRIPTION OF EMBODIMENTS

Example implementations are now described more comprehensively with reference to the accompanying drawings. However, the example implementations may be implemented in various forms and should not be construed as being limited to the implementations set forth herein. On the contrary, these implementations are provided such that the present disclosure is comprehensive and complete and the concept of the example implementations is comprehensively communicated to a person skilled in the art. Same reference signs in the drawings indicate same or similar structures, and therefore detailed descriptions thereof will be omitted.

A technical problem to be resolved by the present disclosure is how to provide a detachable structure that can implement quick disassembly/assembly of functional components of a self-moving robot.

Another technical problem to be resolved by the present disclosure is how to provide a self-moving robot having the foregoing detachable structure.

Additional aspects and advantages of the present disclosure are partially set forth in the following description and partially become clear from the description, or may be learned by practicing the present disclosure.

Figure 4:
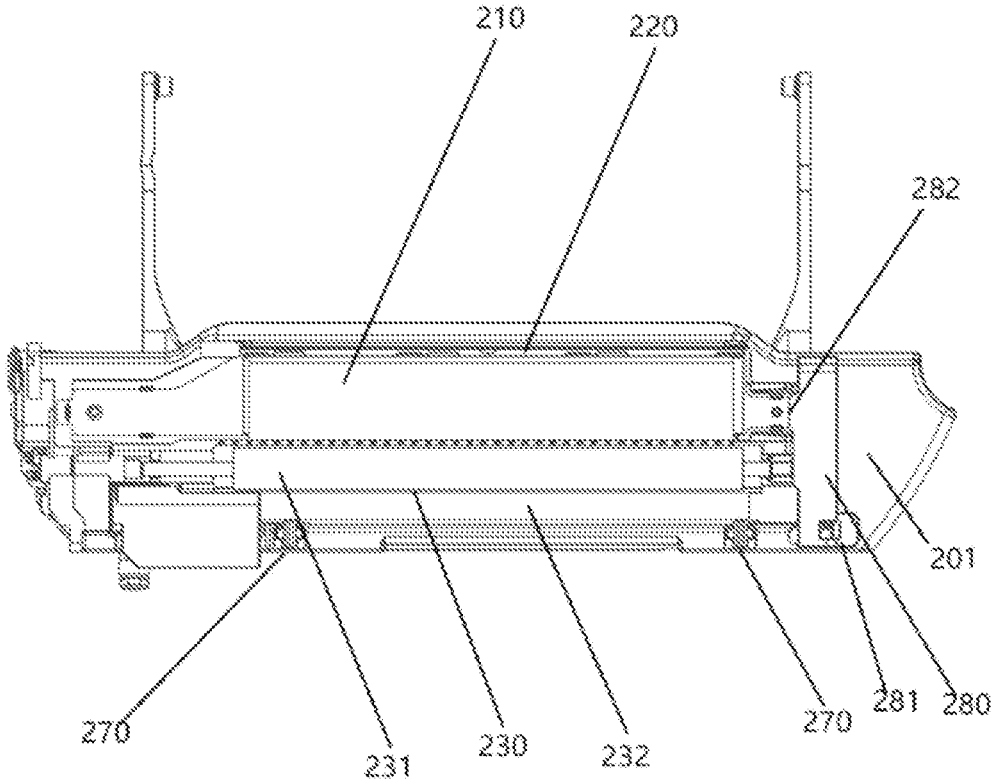
FIG. 4 is a bottom view of a wet cleaning apparatus according to an embodiment of the present disclosure.

FIG. 4 representatively shows a bottom view of a self-moving robot 100 provided in the present disclosure. The self-moving robot 100 provided in the present disclosure may include a wet cleaning apparatus 200. The wet cleaning apparatus 200 includes a housing 201 and a cleaning assembly disposed in the housing 201 (the cleaning assembly may include a cleaning head 210, a water supply mechanism 220, and a water return mechanism 230, the water feed mechanism 220 is configured to supply clean water to the cleaning head 210, and the water return mechanism 230 is configured to collect dirty water on a surface cleaned by the cleaning head 210). On this basis, the self-moving robot 100 provided in the present disclosure may further include a detachable structure. Specifically, the detachable structure includes a pressure plate 280, the pressure plate 280 has a connection end 281 and a movable end 282, the connection end 281 is connected to the housing 201, and the movable end 282 is adjustably clamped to the housing 201. Accordingly, when the movable end 282 and the housing 201 are in a clamped state, the movable end 282 blocks a partial structure of the cleaning assembly to enable the cleaning assembly to abut against the housing 201. When the movable end 282 and the housing 201 are in a non-clamped state, the cleaning assembly is removable from the housing 201. According to the foregoing design, the user can detach, clean, and replace the cleaning assembly, such as the cleaning head 210, a water suction roller 231, and a recovery rod 232, more conveniently by using the detachable structure. In addition, the detachable structure facilitates later maintenance and repair of the self-moving robot 100.

Optionally, as shown in FIG. 4, based on the design that the detachable structure is disposed for the wet cleaning apparatus 200, in this implementation, the connection end 281 may be pivoted to the housing 201. In other implementations, the connection end 281 may be connected to the housing 201 in other manners. For example, the connection end 281 may be clamped or hinged to the housing 201, or may be detachably connected to the housing 201 through a connection member. None of the other implementations is limited to this implementation.

Further, as shown in FIG. 4, based on the design that the detachable structure is disposed for the wet cleaning apparatus 200, and based on the design that the connection end 281 is pivoted to the housing 201, in this implementation, the connection end 281 may be pivoted to the housing 201 through a pivot shaft. In other implementations, the connection end 281 may be connected to the housing 201 through other structures, such as a pin. None of the other implementations is limited to this implementation.

Further, as shown in FIG. 4, based on the design that the detachable structure is disposed for the wet cleaning apparatus 200, and based on the design that the connection end 281 is pivoted to the housing 201 through the pivot shaft, in this implementation, a first pivot hole may be disposed in the connection end 281. Correspondingly, the housing 201 may have a pivoting structure, and second pivot holes are respectively disposed at positions of the pivoting structure corresponding to two sides of the connection end 281. On this basis, the pivot shaft passes through the first pivot hole and the second pivot holes to pivot the connection end 281 to the housing 201.

Optionally, as shown in FIG. 4, based on the design that the detachable structure is disposed for the wet cleaning apparatus 200, in this implementation, a first clamping structure may be disposed on the movable end 282. Correspondingly, a second clamping structure may be disposed on a position of the housing 201 corresponding to the movable end 282, and the first clamping structure is engaged with the second clamping structure through clamping. Specifically, the two clamping structures may be in a structure form such as a mutually-matched male clamping head and female clamping head, two mutually-matched clamping tenons, or a mutually-matched clamping post and clamping hole. None of the structure forms is limited to this implementation.

Optionally, as shown in FIG. 4, based on the design that the detachable structure is disposed for the wet cleaning apparatus 200, in this implementation, the housing is defined with accommodation space for accommodating the cleaning head 210, the cleaning head 210 provided with two connection end portions opposite to each other, a connection end portion is detachably connected to an end of the accommodation space, and the other connection end portion is located at the other end of the accommodation space. On this basis, the movable end 282 is adjustably clamped to the other end of the accommodation space. Accordingly, when the movable end 282 and the housing 201 are in a clamped state, the other connection end portion of the cleaning head 210 is pressed against and positioned on the other end of the accommodation space by the pressure plate 280.

Optionally, as shown in FIG. 4, based on the design that the detachable structure is disposed for the wet cleaning apparatus 200, in this implementation, the housing is defined with accommodation space for accommodating the water return mechanism 230, the water return mechanism 230 is provided with two connection end portions opposite to each other, a connection end portion is detachably connected to an end of the accommodation space, the other connection end portion is located at the other end of the accommodation space. On this basis, the movable end 282 is adjustably clamped to the other end of the accommodation space. Accordingly, when the movable end 282 and the housing 201 are in a clamped state, the other connection end portion of the water return mechanism 230 is pressed against and positioned on the other end of the accommodation space by the pressure plate 280.

Based on the foregoing description, in this implementation, both the cleaning head 210 and the water return mechanism 230 (including the water suction roller 231 and the recovery rod 232) are disposed in the accommodation space, one end of each of the cleaning head 210 and the water return mechanism 230 is detachably connected to one end (one end in the same direction) of the accommodation space, and the other end of each of the cleaning head 210 and the water return mechanism 230 can be positioned, through pressure, at the other end of the accommodation space by the movable end 282 of the pressure plate 280. In other implementations, only accommodation space for accommodating the cleaning head 210, or only accommodation space for accommodating the water return mechanism 230, or different accommodation space for respectively accommodating the cleaning head 210 and the water return mechanism 230 may be respectively disposed in the housing 201. On this basis, the movable end 282 of the pressure plate 280 may respectively correspond to the foregoing accommodation space to position, through pressure, at least one of the cleaning head 210 and the water return mechanism 230, thereby providing a quick detachment function for functional structures of the wet cleaning apparatus 200 of the self-moving robot 100.

Based on the detailed description of the exemplary implementation of the detachable structure provided in the present disclosure, the following describes an exemplary implementation of the self-moving robot 100 provided in the present disclosure.

In this implementation, the self-moving robot 100 provided in the present disclosure includes the detachable structure provided in the present disclosure and described in the foregoing implementation in detail.

Figure 13:
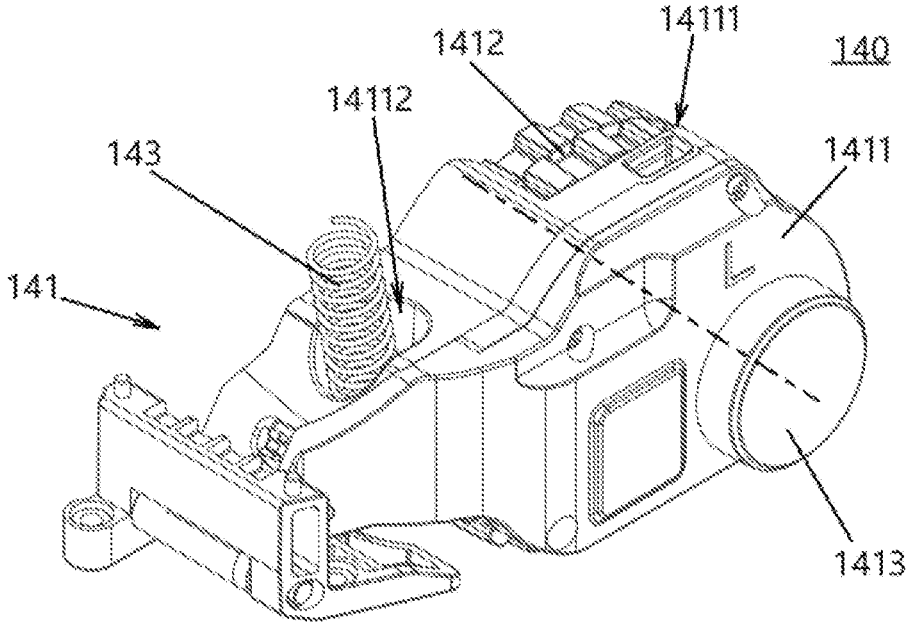
FIG. 13 is a perspective view of a drive wheel module on one side according to an embodiment of the present disclosure.
Figure 14:
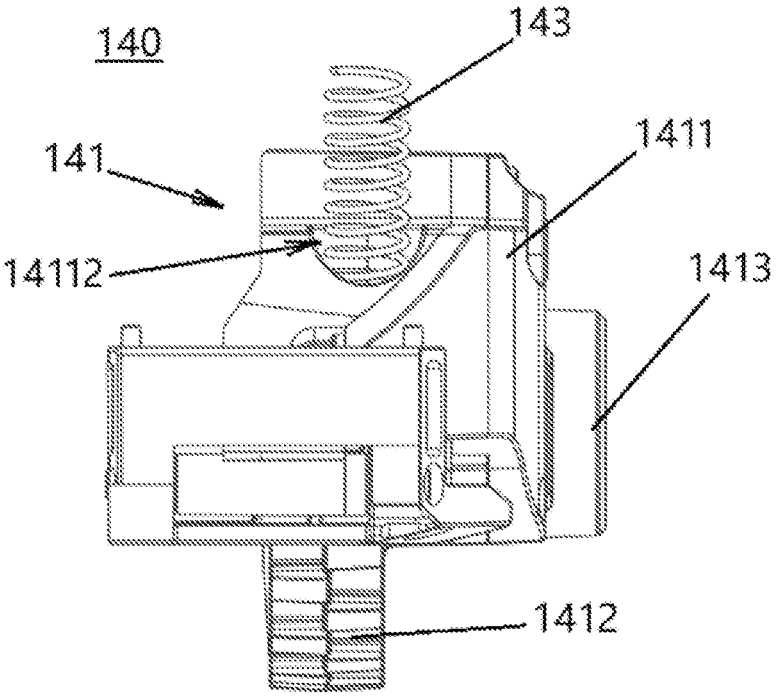
FIG. 14 is a front view of a drive wheel module on one side according to an embodiment of the present disclosure.

FIG. 13 and FIG. 14 representatively show a perspective view and a side view of a drive wheel module 141 provided in the present disclosure in an exemplary implementation, respectively. The self-moving robot 100 provided in the present disclosure includes the drive wheel module 141. The drive wheel module 141 is applicable to the self-moving robot 100, and includes a body portion 1411, a drive wheel 1412, and a drive motor 1413. Specifically, one end of the body portion 1411 is connected to a rack 110 of the self-moving robot 100. The drive wheel 1412 is disposed in the body portion 1411. The drive motor 1413 is disposed in the body portion 1411 and in transmission connection with the drive wheel 1412 to rotate the drive wheel 1412.

The drive wheel module 141 provided in the present disclosure is applicable to the self-moving robot 100, and the self-moving robot 100 includes the rack 110. On this basis, the drive wheel module 141 provided in the present disclosure includes the body portion 1411, the drive wheel 1412, and the drive motor 1413.

The drive wheel module 141 provided in the present disclosure includes a body portion 1411, a drive wheel 1412, and an elastic element 143. Specifically, one end of the body portion 1411 is connected to a rack 110. The drive wheel 1412 is disposed in the body portion 1411, and the drive wheel 1412 is driven by a drive motor 1413. The elastic element 143 is arranged substantially along a vertical plane and is not limited to the vertical arrangement. The elastic element 143 has an upper end and a lower end. The lower end of the elastic element 143 is connected to the body portion 1411, and the upper end of the elastic element 143 is connected to the rack 110. On this basis, when the self-moving robot 100 is placed on the ground, the elastic element 143 is in a compressed state due to a pressing force generated by the weight of the self-moving robot 100. According to the foregoing design, the drive wheel module 141 provided in the present disclosure provides a substantially downward elastic force between the rack 110 and the body portion 1411 through the elastic element 143, to provide a certain grounding force for the drive wheel module 141 to maintain contact and traction with the ground, and provide cushioning and shock absorption functions for the drive wheel module 141 during walking of the self-moving robot 100, so that the drive wheel module 141 disposed with the elastic element 143 forms an offset drop suspension system, thereby ensuring effective driving and good passability of the drive wheel module 141.

Based on the detailed description of the exemplary implementation of the drive wheel module 141 provided in the present disclosure, the following describes an exemplary implementation of the self-moving robot 100 provided in the present disclosure.

In this implementation, the self-moving robot 100 provided in the present disclosure includes the drive wheel module 141 provided in the present disclosure and described in the foregoing implementation in detail.

Optionally, as shown in FIG. 13 and FIG. 14, the drive motor 1413 is disposed in the body portion 1411. In this implementation, the drive motor 1413 may be located on an outer side of the drive wheel 1412 relative to the middle of the rack 110. According to the foregoing design, the drive wheel module 141 provided in the present disclosure is not affected by the space of other functional structures (such as the wet cleaning apparatus 200 and a dry cleaning apparatus) disposed in the middle of the rack 110 of the self-moving robot 100. Therefore, the drive motor 1413 and the drive wheel 1412 can be arranged more conveniently and reasonably, and relatively large space can be left between the drive motor 1413 and the drive wheel 1412, to facilitate installation, maintenance, and replacement of the drive wheel 1412 and the drive motor 1413 while facilitating arrangement of other structures such as a transmission assembly.

Further, as shown in FIG. 13, based on the design that the drive motor 1413 is located outside the drive wheel 1412, in this implementation, the drive wheel 1412 may have an axle. On this basis, the axis of the drive motor 1413 and the axle may be preferably located on the same axis. For the axis, refer to a broken line shown in FIG. 13. That is, the drive wheel 1412 is arranged coaxially with the axis of the drive motor 1413. According to the foregoing design, the drive wheel 1412 can be in transmission connection with the drive motor 1413 more conveniently, and other structures such as the transmission assembly can be arranged more conveniently, thereby further optimizing structural arrangement of the drive wheel module 141. In other implementations, the drive wheel 1412 and the drive motor 1413 may be arranged in a non-coaxial manner, that is, the axle of the drive wheel 1412 and the axis of the drive motor 1413 may be staggered in the radial direction of the drive wheel 1412, to meet arrangement requirements of different types of drive wheels 1412 and drive motors 1413 and different forms of transmission assemblies or other structures. For example, in another implementation, the axis of the drive motor 1413 may be located within a projected area of the drive wheel 1412. None of the other implementations is limited to this implementation.

Further, as shown in FIG. 13, based on the design that the drive motor 1413 is located outside the drive wheel 1412, in this implementation, the drive wheel 1412 may be in transmission connection with the drive motor 1413 through the transmission assembly. The transmission assembly may include a decelerator and a transmission gear set. Specifically, based on the design that the drive wheel 1412 has the axle, the drive motor 1413 may be connected to an input end of the decelerator, and subject to speed adjustment by the decelerator; and an output end of the decelerator may be connected to the transmission gear set, and connected to the axle of the drive wheel 1412 through the transmission gear set. According to the foregoing design, the drive motor 1413 can have a speed adjustment function for driving the drive wheel 1412, and power transmission can be smoother. In other implementations, the transmission assembly may include only the decelerator, or may include only the transmission gear set, or may include other forms of transmission structures. None of the other implementations is limited to this implementation.

Further, as shown in FIG. 13, based on the design that the drive motor 1413 is located outside the drive wheel 1412, in this implementation, the drive wheel 1412 may be disposed on an inner side of the body portion 1411 relative to the middle of the rack 110. According to the foregoing design, the design of the drive wheel 1412 can be used to leave more space for arranging the drive motor 1413 and other structures in the body portion 1411, thereby further optimizing a structural arrangement form of the drive wheel module 141. In other implementations, the drive wheel 1412 may be disposed at other positions of the body portion 1411, for example, in the middle of the body portion 1411. None of the other implementations is limited to this implementation.

Further, as shown in FIG. 13, based on the design that the drive wheel 1412 is disposed on the inner side of the body portion 1411 relative to the middle of the rack 110, in this implementation, an accommodation part 14111, such as a groove or a recess, may be disposed on the inner side of the body portion 1411 relative to the middle of the rack 110. On this basis, the drive wheel 1412 is partially accommodated in the accommodation part 14111, and the bottom of the drive wheel 1412 protrudes from the accommodation part 14111 to be in contact with the ground, to implement a walking function.

Optionally, as shown in FIG. 13 and FIG. 14, in this implementation, one end of the body portion 1411 is connected to the rack 110, and the drive wheel module 141 may further include an elastic element 143. The elastic element 143 is arranged substantially along a vertical plane and is not limited to the vertical arrangement. The elastic element 143 has an upper end and a lower end. The lower end of the elastic element 143 is connected to the body portion 1411, and the upper end of the elastic element 143 is connected to the rack 110. On this basis, when the self-moving robot 100 is placed on the ground, the elastic element 143 is in a compressed state due to a pressing force generated by the weight of the self-moving robot 100. Accordingly, the elastic element 143 can provide a substantially downward elastic force between the rack 110 and the body portion 1411, to provide a certain grounding force for the drive wheel module 141 to maintain contact and traction with the ground, and provide cushioning and shock absorption functions for the drive wheel module 141 during walking of the self-moving robot 100, so that the drive wheel module 141 disposed with the elastic element 143 forms an offset drop suspension system.

Further, as shown in FIG. 13, based on the design that the drive wheel module 141 includes the elastic element 143, in this implementation, a connection position of the elastic element 143 and the body portion 1411 may be between the one end of the body portion 1411 and the drive wheel 1412. In other implementations, a connection position of the elastic element 143 and the body portion 1411 may be on a side of the drive wheel 1412 relatively away from the one end of the body portion 1411, that is, the drive wheel 1412 may be located between the one end of the body portion 1411 and the elastic element 143. Alternatively, a connection position of the elastic element 143 and the body portion 1411 may be inside or outside the drive wheel 1412. None of the other implementations is limited to this implementation.

Further, as shown in FIG. 13, based on the design that the drive wheel module 141 includes the elastic element 143, in this implementation, a groove 14112 may be disposed on the top of the body portion 1411. On this basis, the lower end of the elastic element 143 is disposed in the groove 14112.

Further, as shown in FIG. 13, based on the design that the drive wheel module 141 includes the elastic element 143, in this implementation, the elastic element 143 may be inclined to the one end of the body portion 1411 in the direction from the body portion 1411 to the rack 110. According to the foregoing design, the direction in which the elastic force provided by the elastic element 143 is applied to the body portion 1411 can be kept as far as possible in the movement direction of the body portion 1411 relative to the rack 110, thereby optimizing a grounding force and a cushioning effect provided by the elastic element 143.

Further, as shown in FIG. 13, based on the design that the drive wheel module 141 includes the elastic element 143, in this implementation, the elastic element 143 may include a spring. Further, the spring may be a tension spring or a compression spring. In other implementations, the elastic element 143 may include a spring plate or a leaf spring. None of the other implementations is limited to this implementation.

Optionally, in this implementation, the self-moving robot 100 provided in the present disclosure includes two drive wheel modules 141, and the two drive wheel modules 141 are symmetrically arranged relative to the rack 110. In other implementations, the self-moving robot 100 may include multiple pairs of drive wheel modules 141. None of the other implementations is limited to this implementation.

Further, based on the design that the self-moving robot 100 includes at least one pair of drive wheel modules 141, in this implementation, the self-moving robot 100 provided in the present disclosure includes a dry cleaning apparatus. The dry cleaning apparatus is disposed at the bottom of the rack 110. On this basis, the two drive wheel modules 141 of the same pair are respectively located at two ends of the dry cleaning apparatus. Based on the foregoing example descriptions, the following describes in detail structures, connection manners, and functional relationships of main components of the self-moving robot provided in the present disclosure.

Figure 2:
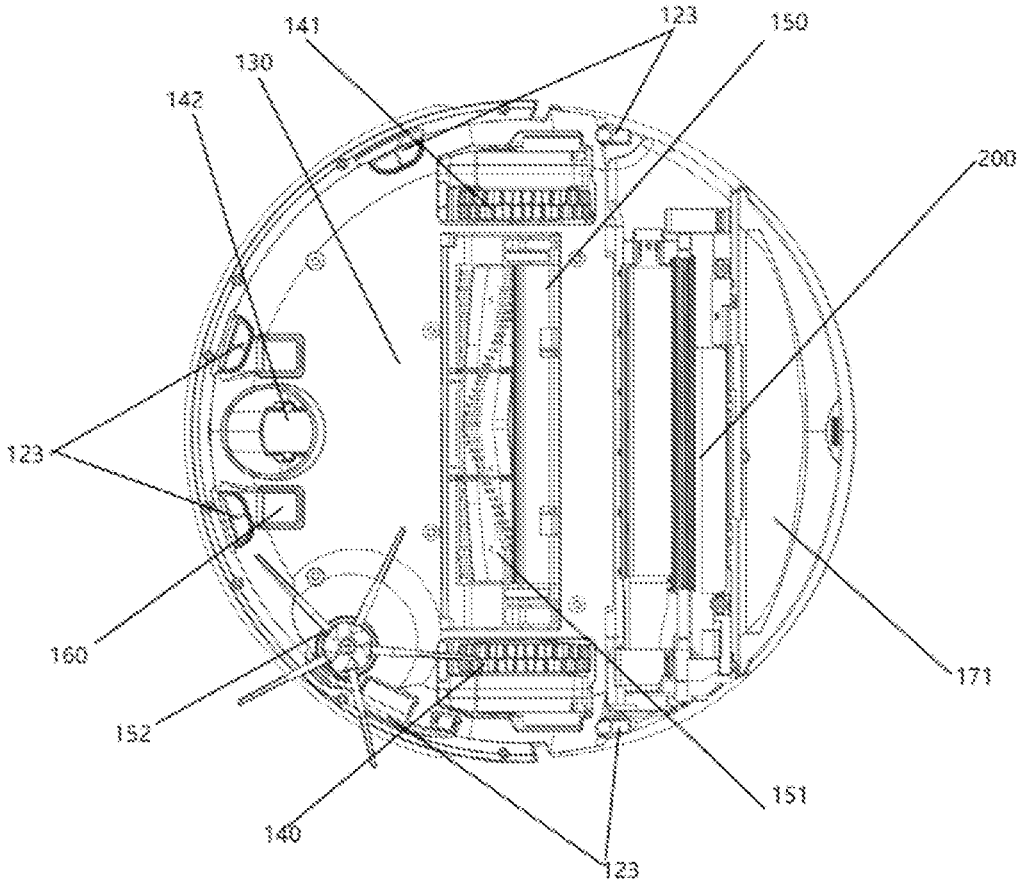
FIG. 2 is a schematic diagram of a bottom structure of a self-moving robot according to an embodiment of the present disclosure.

FIG. 1 and FIG. 2 are schematic structural diagrams of a robot according to an example embodiment. As shown in FIG. 1 and FIG. 2, the robot 100 may be an automatic cleaning device such as a self-moving robot or a mopping robot. The robot 100 may include a rack 110, a sensing system 120, a control system 130, a drive system 140, a dry cleaning apparatus 150, an energy system 160, and a human-computer interaction system 170.

The sensing system 120 includes a position determining apparatus 121 located on the rack 110, a buffer 122 located at a forward part 111 of the rack 110, and sensing apparatuses such as a cliff sensor 123, an ultrasonic sensor (not shown in the figure), an infrared sensor (not shown in the figure), a magnetometer (not shown in the figure), an accelerometer (not shown in the figure), a gyroscope (not shown in the figure), and an odometer (not shown in the figure); and provides various types of position information and motion state information of the machine for the control system 130. The position determining apparatus 121 includes but is not limited to a camera and a laser distance sensor (LDS).

The components of the sensing system 120 may operate independently, or may operate jointly to more accurately implement a target function. A to-be-cleaned surface is identified by using the cliff sensor 123 and the ultrasonic sensor, to determine physical characteristics of the to-be-cleaned surface, including a surface material, a cleaning degree, etc., and the physical characteristics of the to-be-cleaned surface may be determined more accurately in combination with the camera, the laser distance sensor, etc.

For example, the ultrasonic sensor may be used to determine whether the to-be-cleaned surface is a carpet. If the ultrasonic sensor determines that the to-be-cleaned surface is a carpet material, the control system 130 controls the robot 100 to perform carpet mode cleaning.

The buffer 122 may be born in the forward part 111 of the rack 110. In a cleaning process, when the drive wheel module 141 pushes the robot to walk on the ground, the buffer 122 detects one or more events (or objects) in a travelling path of the robot 100 by using a sensor system, such as the infrared sensor. The robot may control, based on the events (or objects) detected by the buffer 122, such as an obstacle or a wall, the drive wheel module 141 to enable the robot to respond to the events (or objects), for example, stay away from the obstacle.

The control system 130 is disposed on a circuit mainboard in the rack 110 and includes a computing processor, such as a central processing unit or an application processor, which communicates with a non-transitory memory, such as a hard disk, a flash memory, or a random access memory. The application processor draws an instant map of an environment in which the robot is located based on obstacle information fed back by the laser distance sensor by using a positioning algorithm, such as SLAM. The control system 130 comprehensively determines a current working state of the sweeper with reference to distance information and speed information fed back by the buffer 122 and the sensing apparatuses such as the cliff sensor 123, the ultrasonic sensor, the infrared sensor, the magnetometer, the accelerometer, the gyroscope, and the odometer. For example, the current working state of the sweeper is crossing a threshold, climbing a carpet, being located at a cliff, being stuck above or below, having a full dust box, or being picked up. The control system 130 further provides specific next action polices based on different conditions, so that the work of the robot more conforms to requirements of the owner and the owner has better user experience. Further, the control system can plan the most efficient and reasonable cleaning path and cleaning mode based on information about the instant map drawn by using SLAM, thereby greatly improving the cleaning efficiency of the robot.

The drive system 140 may operate the robot 100 to travel across the ground based on a drive command including distance and angle information, such as x, y, and 0 components. FIG. 13 and FIG. 14 are a perspective view and a front view of a drive wheel module 141 on one side according to an embodiment of the present disclosure. As shown in the figures, the drive system 140 includes the drive wheel module 141. The drive wheel module 141 can simultaneously control a left wheel and a right wheel. To more accurately control movement of the machine, the drive wheel module 141 preferably includes both a left drive wheel module and a right drive wheel module. The left and right drive wheel modules are opposite to each other along a transverse axis defined by the rack 110.

To enable the robot to move more stably on the ground or have a stronger movement capability, the robot may include one or more driven wheels 142. The driven wheel includes but is not limited to a universal wheel. The drive wheel module includes a walking wheel, a drive motor, and a control circuit for controlling the drive motor. The drive wheel module may be further connected to a circuit for measuring a drive current and the odometer. The drive wheel module 141 is detachably connected to the rack 110 to facilitate disassembly/assembly and maintenance. The cleaning element of the robot 100 is in contact with the to-be-cleaned surface with certain pressure.

The main cleaning function of the dry cleaning apparatus 150 comes from a cleaning system 151 including a rolling brush structure, a dust box structure, a fan structure, an air outlet, and connection components between the four components. The rolling brush structure that interferes with the ground to a certain degree sweeps garbage on the ground and rolls the garbage to the front of a dust suction port between the rolling brush structure and the dust box structure, and then the garbage is sucked into the dust box structure by a suction gas generated by the fan structure and passing through the dust box structure. The dust removal capability of the sweeper can be represented by dust pickup efficiency DPU (Dust pickup efficiency). The dust pickup efficiency DPU is affected by the rolling brush structure and material, is affected by the wind utilization of an air duct including the dust suction port, the dust box structure, the fan structure, the air outlet, and the connection components between the four components, and is affected by the type and power of the fan. Therefore, the dust removal capability of the sweeper is a complex system design problem. Compared with an ordinary plug-in vacuum cleaner, the improvement of the dust removal capacity is of greater significance for a self-moving robot with limited energy. Because the improvement of the dust removal capacity directly effectively reduces an energy requirement. To be specific, an original machine that can clean 80 square meters of ground by being charged once can be evolved into a machine that can clean 180 square meters or more of ground by being charged once. In addition, the service life of a battery charged fewer times is also greatly increased, so that the frequency of battery replacement by the user is also reduced. More intuitively and importantly, the improvement of the dust removal capability is the most obvious and important user experience, and the user can directly draw a conclusion on whether the to-be-cleaned surface is swept clean or mopped clean. The dry cleaning apparatus may further include a side brush 152 with a rotating shaft. The rotating shaft is at an angle relative to the ground for moving debris into a rolling brush area of the dry cleaning apparatus 150.

The energy system 160 includes a rechargeable battery, such as a nickel-metal hydride battery and a lithium battery. The rechargeable battery may be connected to a charging control circuit, a battery pack charging temperature detection circuit, and a battery undervoltage monitoring circuit. Then, the charging control circuit, the battery pack charging temperature detection circuit, and the battery undervoltage monitoring circuit are connected to a single-chip microcomputer control circuit. The host is connected to a charging pile for charging by using charging electrodes disposed on the side of or under the machine body. If the exposed charging electrodes are covered with dust, during charging, due to a charge accumulation effect, the plastic machine body around the electrodes may melt and deform, and even the electrodes may deform. As a result, normal charging cannot be continued.

The human-computer interaction system 170 includes buttons on a host panel for the user to select functions; may further include a display screen and/or an indicator and/or a loudspeaker, where the display screen, the indicator, and the loudspeaker display a current machine state or function options to the user; and may further include a mobile phone client program. A cleaning device of a path navigation type may display, at a mobile phone client, a map of an environment in which the device is located and the position of the machine to the user, and may provide richer and more humanized function items for the user.

The human-computer interaction system 170 further includes a tail light 171 disposed on the chassis.

To more clearly describe behavior of the robot, the following direction definitions are made: The robot 100 may travel on the ground by using various combinations of movements relative to the following three mutually perpendicular axes defined by the rack 110: a transverse axis x, a longitudinal axis y, and a central vertical axis z. A forward drive direction along the longitudinal axis y is denoted as "forward", and a backward drive direction along the longitudinal axis y is denoted as "backward". The transverse axis x substantially extends between the right and left wheels of the robot along the axis defined by the center point of the drive wheel module 141. The robot 100 can rotate around the x axis. When the forward part of the robot 100 is inclined upward and the backward part of the robot 100 is inclined downward, the robot 100 is "upward". When the forward part of the robot 100 is inclined downward, and the backward part of the robot 100 is inclined upward, the robot 100 is "downward". In addition, the robot 100 can rotate around the z axis. In a front direction of the robot, when the robot 100 is inclined to the right of they axis, the robot 100 is "turn right". When the robot 100 is inclined to the left of they axis, the robot 100 is "turn left".

Figure 3:
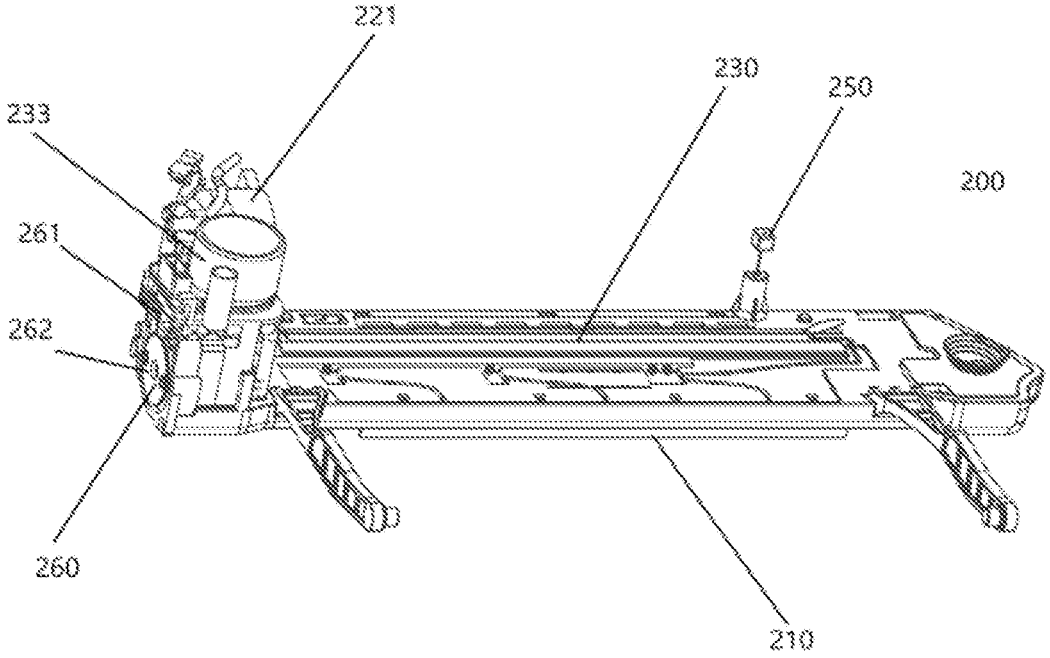
FIG. 3 is a perspective view of a wet cleaning apparatus according to an embodiment of the present disclosure.
Figure 5:
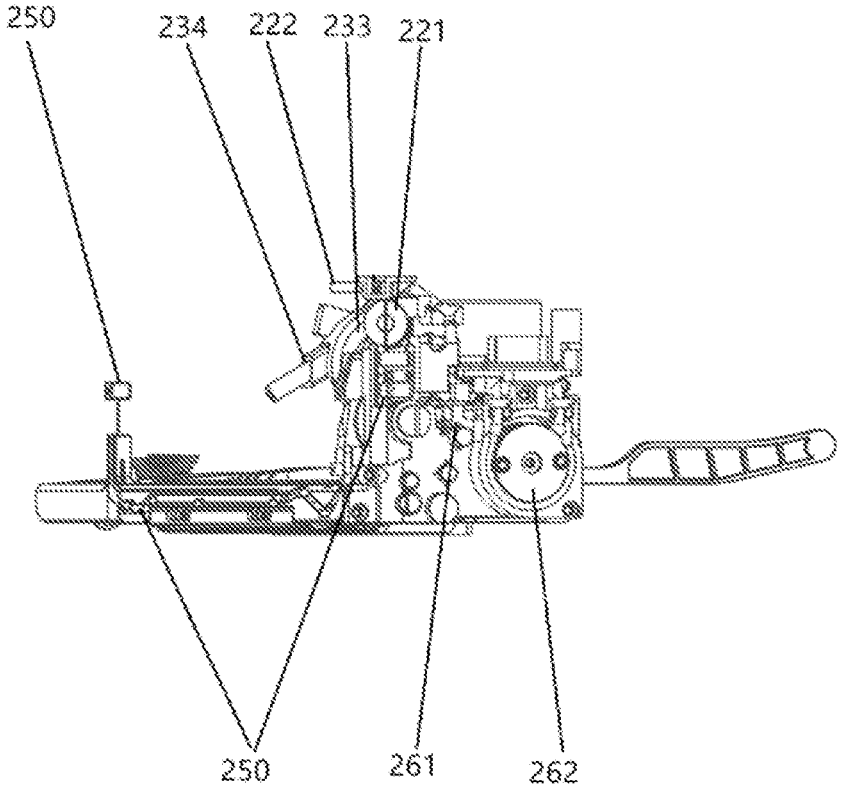
FIG. 5 is a side view of a wet cleaning apparatus according to an embodiment of the present disclosure.
Figure 6:
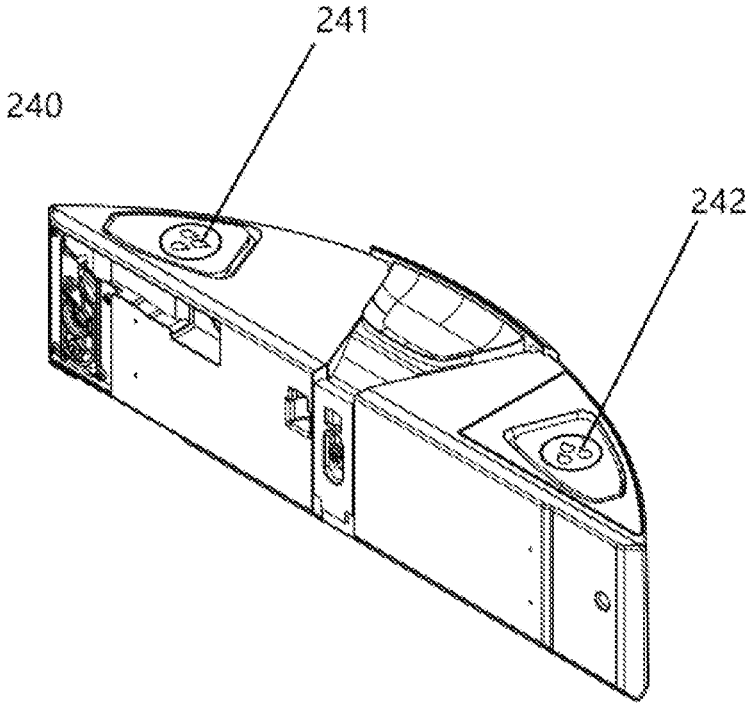
FIG. 6 is a perspective view of a water sink according to an embodiment of the present disclosure.

FIG. 3 to FIG. 5 show a wet cleaning apparatus 200, including at least one cleaning head 210, and including a water supply mechanism 220, a water return mechanism 230, a water tank 240, and a lifting module 250. The wet cleaning apparatus 200 includes a power module 260. The power module simultaneously transmits power of a single motor 262 to the cleaning head 210, the water supply mechanism 220, the water return mechanism 230, the water tank 240, and the lifting module 250 through a power transmission apparatus 261. The energy system 160 supplies power and energy to the power module 260 and is wholly controlled by the control system 130.

The water tank 240 includes a clean water tank 241 and a dirty water tank 242. The clean water tank 241 and the dirty water tank 242 are independent from each other and each are provided with an opening for water injection or cleaning.

Figure 15:
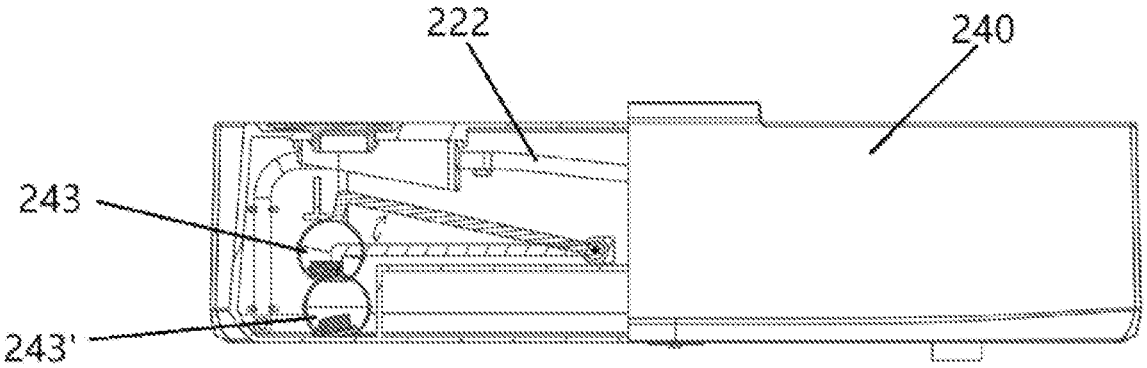
FIG. 15 is a partial cross-sectional view of a water level detection apparatus in a water tank according to an embodiment of the present disclosure.

As shown in FIG. 15, water level detection apparatuses 243 are further disposed in the water tank 240. The water level detection apparatus can detect water level statues in the clean water tank 241 and the dirty water tank 242. When water in the clean water tank 241 is insufficient or water in the dirty water tank 242 is excessive, the user is reminded of manual intervention by using the display screen and/or the indicator and/or the loudspeaker and/or the mobile phone client program, etc. of the human-computer interaction system 170.

The water level detection apparatus 243 used in this embodiment is a hollow floating design with a magnet disposed inside, and a Hall effect sensor is disposed opposite to the magnet at the bottom of the water tank. When the water amount in the water tank is high, the water level detection apparatus is driven by a float to rise, and the distance between the magnet and the Hall effect sensor becomes longer. When the water amount in the water tank is low, the water level detection apparatus is driven by the float to drop, and the distance between the magnet and the Hall effect sensor becomes shorter. The distance between the magnet and the Hall effect sensor is sensed by using the Hall effect sensor, to determine the water level.

The water level detection apparatus 243 may use other solutions that can detect the water level, such as a resistive type and a capacitive type.

The water supply mechanism 220 includes a clean water pump 221, a clean water pump line 222, and a water outlet structure 223. The water supply structure pumps water from the clean water tank 241 through the clean water pump 221 and the clean water pump pipe 222, and supplies the water to the water outlet structure 223. The water outlet structure 223 may be a nozzle, a dripping hole, a soaking cloth, etc., and uniformly distribute the water in front of the cleaning head 210 to wet the cleaning head 210 and the to-be-cleaned surface. Stains on the wet to-be-cleaned surface can be cleaned more easily.

The cleaning head 210 performs a reciprocating motion along the to-be-cleaned surface, and a cleaning cloth or a cleaning plate is disposed on a contact surface of the cleaning head 210 with the to-be-cleaned surface, so that high-frequency friction is generated with the to-be-cleaned surface through the reciprocating motion, thereby removing stains on the to-be-cleaned surface.

Figure 17:
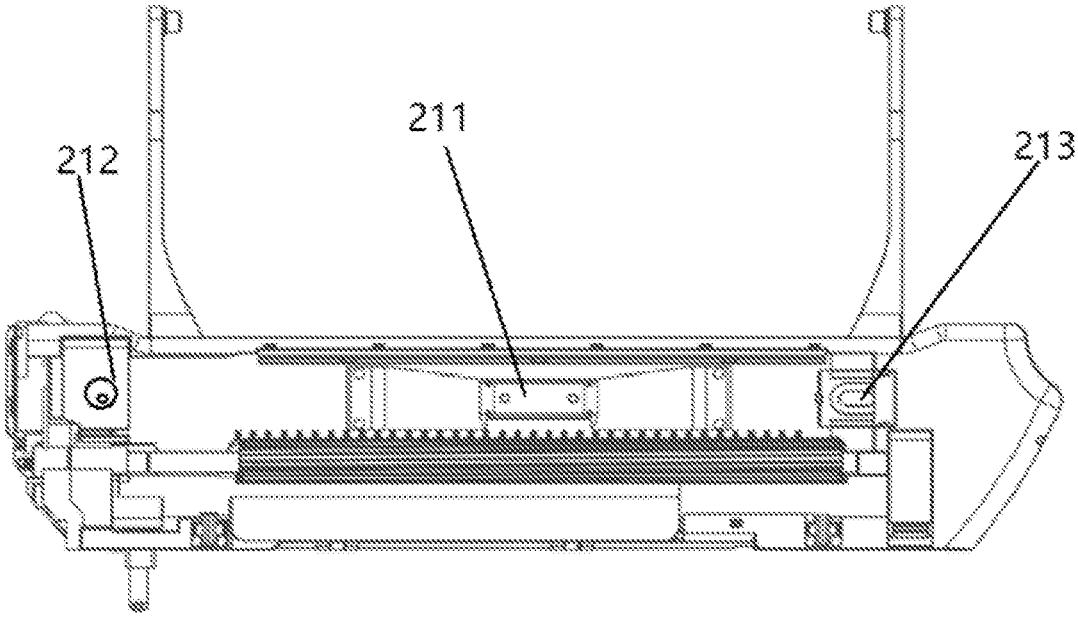
FIG. 17 is a bottom view of a wet cleaning apparatus (excluding a cleaning head) according to an embodiment of the present disclosure.
Figure 18:
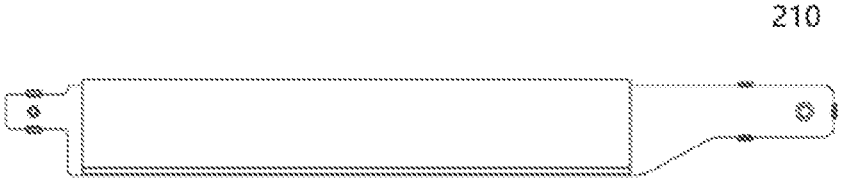
FIG. 18 is a schematic structural diagram of a cleaning head according to an embodiment of the present disclosure.

In this embodiment, as shown in FIG. 17 and FIG. 18, the cleaning head 210 may be made of a material with certain elasticity. Pivot holes are disposed at both ends of the cleaning head 210 and respectively sleeved on a camshaft 212 and a slide rail 213, to implement the reciprocating motion. The cleaning head 210 is supported in the wet cleaning apparatus 200 by using an elastic support structure 211, such as a spring plate, a spring, etc. When the cleaning head 210 works, the cleaning head 210 is always in contact with the to-be-cleaned surface. The distance between the to-be-cleaned surface and the wet cleaning apparatus 200 is not always constant during automatic and/or autonomous cruising of the robot 100. The elasticity of the cleaning head 210 and the elastic support structure 211 enable the distance between the cleaning head 210 and the wet cleaning apparatus 200 to be adjusted passively with the operation surface.

Figure 19:
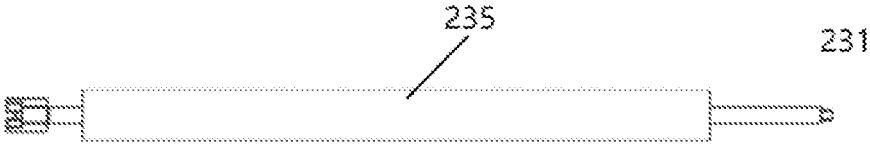
FIG. 19 is a schematic structural diagram of a water suction roller according to an embodiment of the present disclosure.
Figure 20:
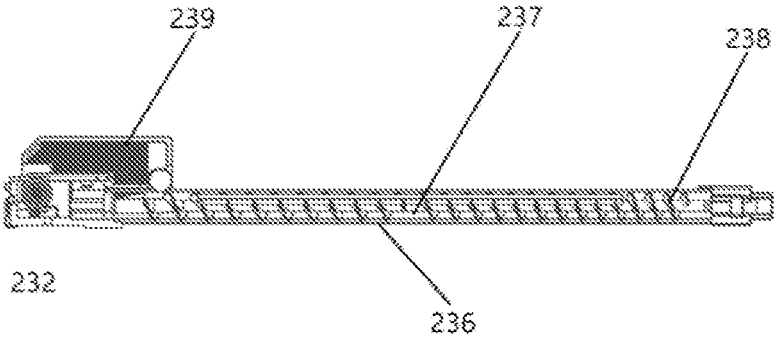
FIG. 20 is a schematic structural diagram of a recovery rod according to an embodiment of the present disclosure.

The water return mechanism 230 includes the water suction roller 231 and the recovery lever 232. The structure of the water suction roller 231 is shown in FIG. 19, and the structure of the recovery rod 232 is shown in FIG. 20. A water suction material 235 is sleeved on the water suction roller 231. The water suction roller 231 rotates synchronously in a cleaning process of the cleaning head 210, and sucks dirty water obtained after the cleaning by the cleaning head 210 through the water suction material 235 on the water suction roller 231. A scraping strip 236 is disposed on the recovery rod 232. The scraping strip 236 is in close contact with the water suction roller 231, and squeezes the water suction material 235 on the water suction roller 231, to enable the dirty water sucked by the absorbent material 235 to flow to a recovery groove 237 of the recovery rod 232. The dirty water in the recovery groove 237 is transferred to one side through a worm structure 238 of the recovery rod 232. A sludge box 239 is disposed at the end of the recovery rod 232 to filter solid impurities in the dirty water. Filtered dirty water is sent to the dirty water tank 242 through a dirty water pump 233 and a dirty water pump pipe 234.

The power of the cleaning head 210, the clean water pump 221, and the dirty water pump 233 all can be automatically and dynamically adjusted based on a working environment of the robot 100. Generally, the user can control the cleaning strength of the cleaning head 210 and the water amount of the water pump by using the human-computer interaction system 170.

Figure 16:
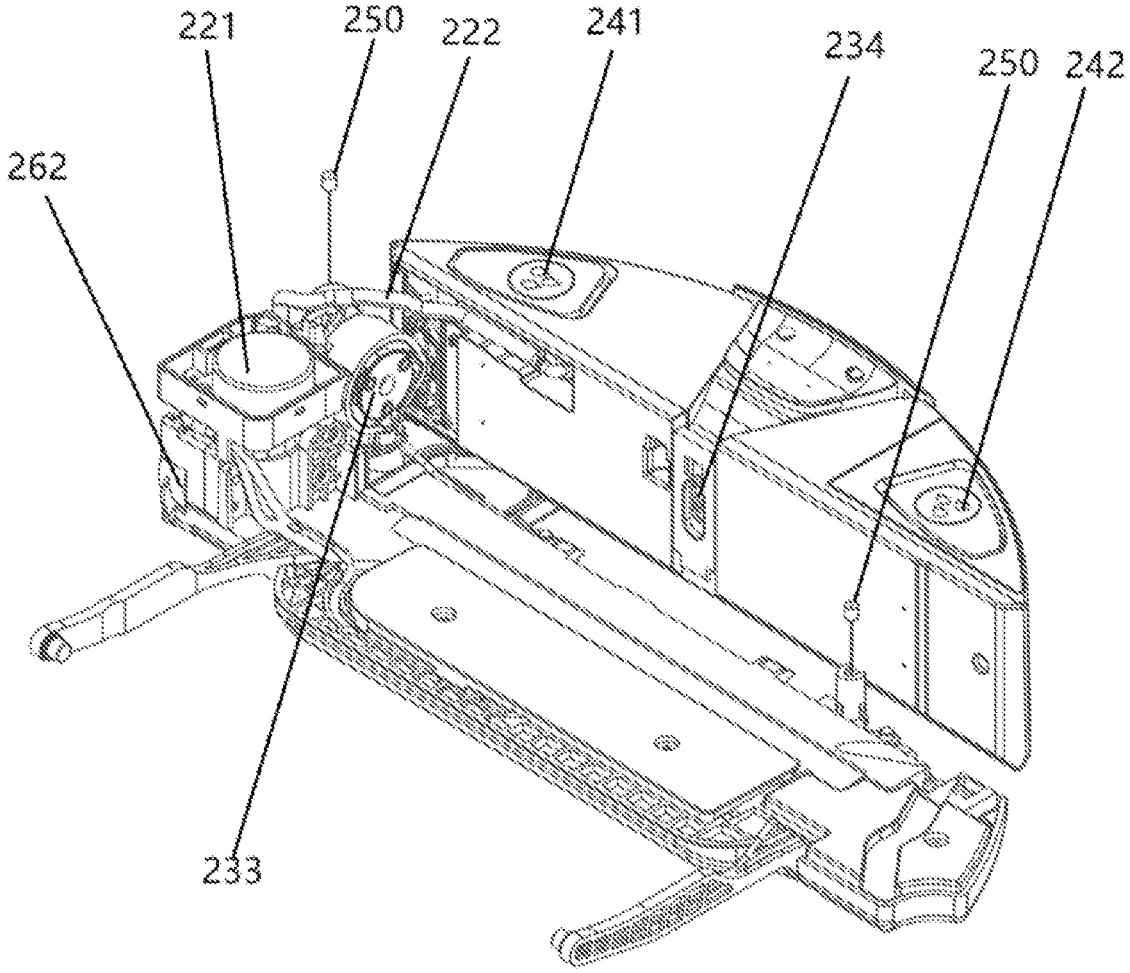
FIG. 16 is a schematic overall assembly diagram of a wet cleaning apparatus (including a water tank) according to an embodiment of the present disclosure.

FIG. 16 is a schematic diagram of an overall assembly effect of the wet cleaning apparatus 200 in this embodiment. The motor 262 is connected to the cleaning head 210, the water suction roller 231, the recovery rod 232, the clean water pump 221, and the dirty water pump 233 through the transmission apparatus. When the wet cleaning apparatus 200 is started, the motor 262 starts to work and rotates forward, and the clean water pump 221 sucks clean water from the clean water tank and sprays the clean water in front of the cleaning head 210 through the water outlet structure 223. The cleaning head 210 cleans the to-be-cleaned surface through reciprocating motion. After being sucked by the water suction roller 231, generated dirty water is recovered by the recovery rod 232, and is sucked from the recovery rod 232 to the dirty water tank through the dirty water pump 233. When the motor 262 rotates reversely, the cleaning head 210, the water suction roller 231, the recovery rod 232, the clean water pump 221, and the dirty water pump 233 do not work, and the lifting module 250 starts to work.

The cleaning intensity/efficiency of the robot 100 can also be automatically and dynamically adjusted based on a working environment of the robot 100. For example, the robot 100 can detect physical information of the to-be-cleaned surface based on the installed sensing system 120 to implement dynamic adjustment. For example, the sensing system 120 may detect information such as the flatness degree of the to-be-cleaned surface, the material of the to-be-cleaned surface, and whether there is oil dirt or dust on the to-be-cleaned surface, and transmit the information to the control system 130 of the robot 100. Correspondingly, the control system 130 may direct the robot 100 to automatically and dynamically adjust the rotational speed of the motor 262 and the transmission ratio of the power transmission apparatus 261 based on a working environment of the robot 100, thereby adjusting a preset reciprocating period of the reciprocating motion of the cleaning head 210.

For example, when the robot 100 works on a flat ground, the preset reciprocating period may be automatically and dynamically adjusted to be longer, and the water amount of the water pump may be automatically and dynamically adjusted to be smaller. When the robot 100 works on a less flat ground, the preset reciprocating period may be automatically and dynamically adjusted to be shorter, and the water amount of the water pump may be automatically and dynamically adjusted to be larger. This is because the flat ground is easier to clean than the less flat ground. Therefore, cleaning an uneven ground requires faster reciprocating motion of the cleaning head 210 (namely, higher frequency) and a greater water amount.

For another example, when the robot 100 works on a tabletop, the preset reciprocating period may be automatically and dynamically adjusted to be longer, and the water amount of the water pump may be automatically and dynamically adjusted to be smaller. When the automatic cleaning device 100 works on a ground, the preset reciprocating period may be automatically and dynamically adjusted to be shorter, and the water amount of the water pump may be automatically and dynamically adjusted to be larger. This is because there is less dust and oil dirty on the tabletop than the ground, and the material constituting the tabletop is also easier to clean. Therefore, the tabletop can be cleaned provided that the cleaning head 210 performs fewer reciprocating motions and the water pump provides a smaller water amount.

Figure 11:
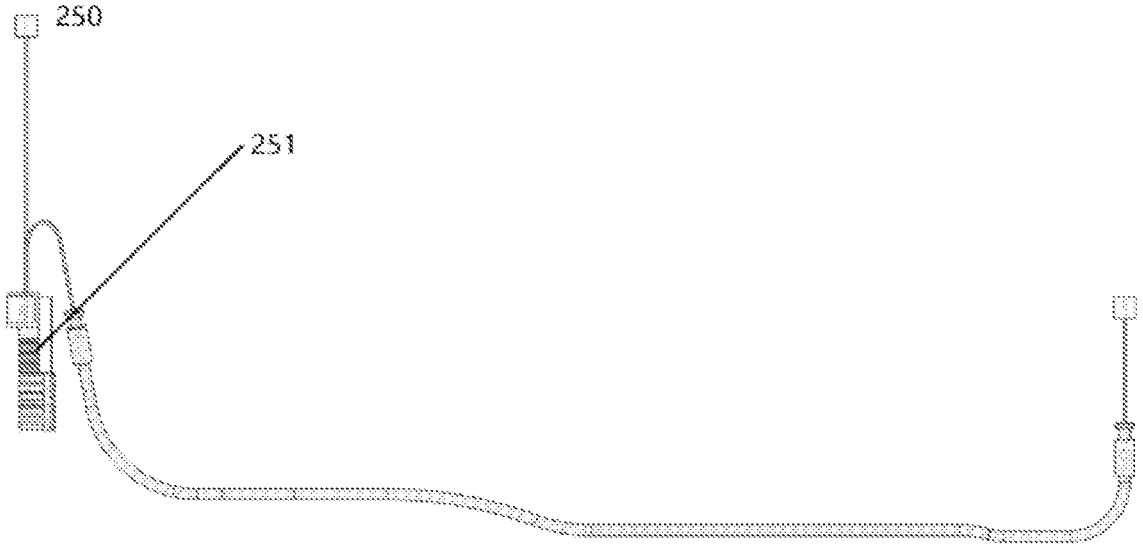
FIG. 11 is a schematic diagram of a lifting module according to an embodiment of the present disclosure.
Figure 12:
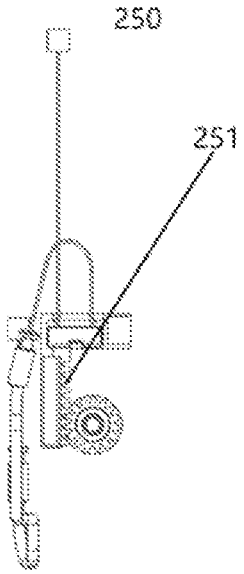
FIG. 12 is a side view of a lifting module according to an embodiment of the present disclosure.

As shown in FIG. 11 and FIG. 12, the lifting module 250 is disposed between the rack 110 and the wet cleaning apparatus 200 and is connected to the motor 262. Both ends of the lifting module 250 are fastened to the rack 110, and the lower part of the lifting module 250 is installed on the wet cleaning apparatus 200. The lifting module 250 dynamically adjusts the distance between the wet cleaning apparatus 200 and the rack 110 through a pulley block, a traction rope, etc.

In this embodiment, the lifting module 250 is connected to the motor 262 through a rack 251. When the motor 262 rotates reversely, the rack is driven to pull down, and the lifting module 250 drives the wet cleaning apparatus 200 to lift up. When the motor 262 works normally, the rack 251 is detached from the gear of the motor 262 after completing a stroke, and the lifting module 250 drives the wet cleaning apparatus 200 back to the working position.

For example, when the user instructs, through the human-computer interaction system 170, the robot 100 that only the dry cleaning apparatus is needed for cleaning, the lifting module 250 shortens the distance between the wet cleaning apparatus 200 and the rack 110. In this case, the wet cleaning apparatus 200 rises away from the to-be-cleaned surface. The distance between the wet cleaning apparatus 200 and the to-be-cleaned surface can also be automatically and dynamically adjusted based on a working environment of the robot 100. For example, the robot 100 can detect the physical information of the to-be-cleaned surface based on the installed sensing system 120. For example, when the sensing system 120 detects that the robot is travelling on the surface of a carpet, the lifting module 250 pulls up the wet cleaning apparatus 200 to enable the wet cleaning apparatus 200 to be detached from the surface of the carpet, to prevent wetting the carpet, while the cleaning head 210, the clean water pump 221, the dirty water pump 233, etc. are all suspended. When the sensing system 120 detects that the robot is detached from the surface of the carpet and returns to a ground such as a floor tile or a floor board, the lifting module 250 puts down the wet cleaning apparatus 200, and components of the wet cleaning apparatus 200 continue to work normally.

Further, a guide wheel 270 is disposed in the wet cleaning apparatus 200. The guide wheel provides better working space for the cleaning head 210, increases the effective contact area between each cleaning unit of the cleaning head 210 and the to-be-cleaned surface while ensuring that a friction force is relatively small when the wet cleaning apparatus is in contact with the to-be-cleaned surface, and reduces the overall power consumption of the robot 100.

Figure 7:
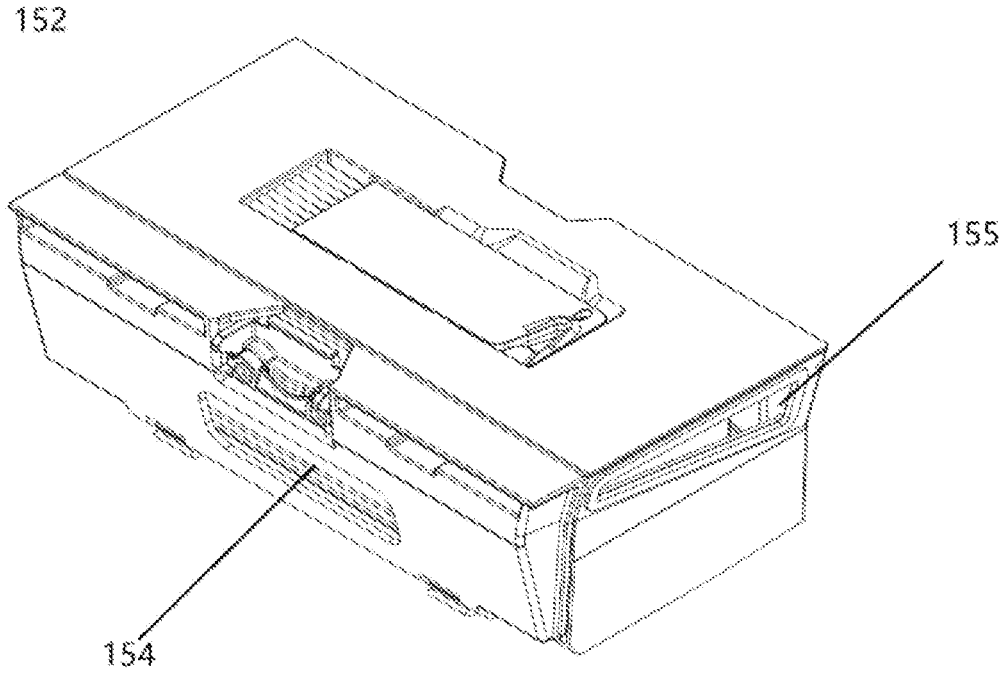
FIG. 7 is a perspective view of a dust box according to an embodiment of the present disclosure.
Figure 8:
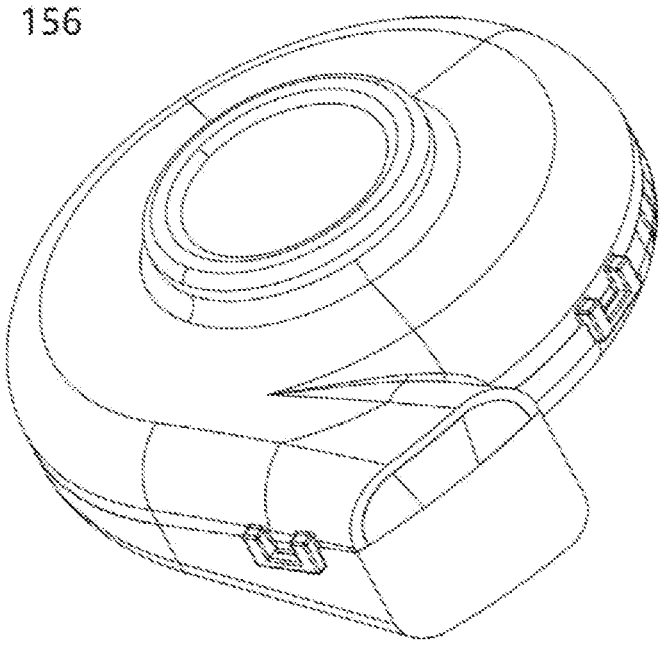
FIG. 8 is a perspective view of a fan according to an embodiment of the present disclosure.
Figure 9:
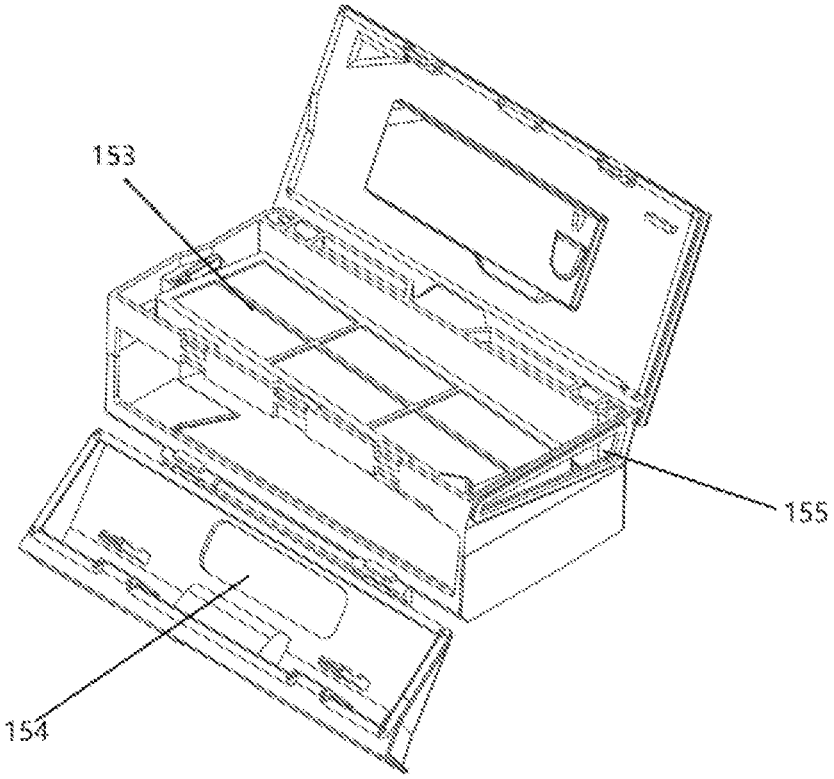
FIG. 9 is a schematic diagram of an open state of a dust box according to an embodiment of the present disclosure.
Figure 10:
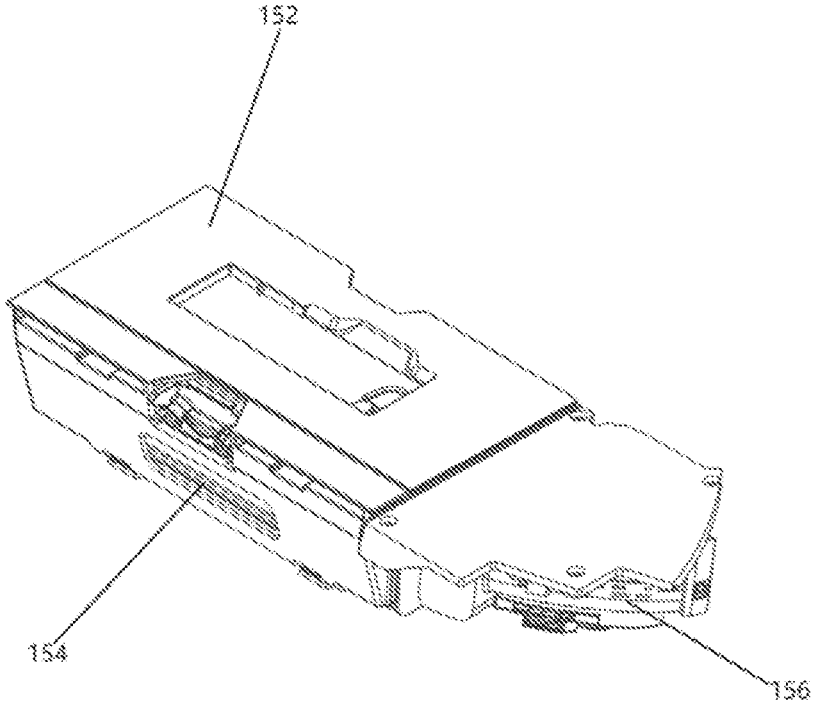
FIG. 10 is a schematic diagram of a combined state of a dust box and a fan according to an embodiment of the present disclosure.

FIG. 7 is a schematic structural diagram of the dust box 152 in the dry cleaning apparatus. FIG. 8 is a schematic structural diagram of the fan 156 in the dry cleaning apparatus. FIG. 9 is a schematic diagram of an open state of the dust box 152. FIG. 10 is a schematic diagram of an assembled state of the dust box and the fan. The rolling brush structure that interferes with the ground to a certain degree sweeps the garbage on the ground and rolls the garbage to the front of the dust suction port 154 between the rolling brush structure and the dust box 152, and then the garbage is sucked into the dust box 152 by a suction gas generated by the fan structure 156 and passing through the dust box 152. The garbage is isolated by a filter screen 153 on an inner side of the dust box 152 close to the dust suction port 154. Filtered air enters the fan 156 through the air outlet 155. Typically, the dust suction port 154 of the dust box 152 is located in the front of the machine, the filter screen 153 is placed horizontally in the middle of the dust box 152, the air outlet 155 is located on the side of the dust box 152, and the filter screen completely isolates the dust suction port from the air outlet It should be noted herein that the self-moving robot shown in the accompanying drawings and described in this specification is merely one example of a variety of self-moving robots that can use the principles of the present disclosure. It should be clearly understood that the principles of the present disclosure are in no way limited to any detail or any component of the self-moving robot shown in the accompanying drawings or described in this specification.

In an implementation, the self-moving robot provided in the present disclosure further includes a rack, a driven wheel, at least one obstacle detection sensor, a dry cleaning apparatus, at least one main brush, at least one side brush, a control system, and a wet cleaning apparatus. The rack includes a top housing and a chassis. The driven wheel is disposed on the chassis. The obstacle detection sensor is configured to detect an obstacle close to or in contact with the self-moving robot, and generate an obstacle detection signal. The obstacle detection sensor includes a touch sensor, a laser radar, an ultrasonic sensor, an infrared sensor, etc. The dry cleaning apparatus includes a fan, an air duct, and a dust box. The fan is configured to suck up stains and dust on a to-be-cleaned surface and send the stains and the dust to the dust box through the air duct. A filter screen and an air outlet are disposed in the dust box. The filter screen covers the air outlet, so that an air flow blown by the fan through the dust box is filtered through the filter screen. The main brush is configured to sweep stains, dust, or hair on the to-be-cleaned surface. The side brush is configured to sweep dust, stains, or hair from the edge of the self-moving robot into a sweeping range of the main brush. The control system is operably coupled to the at least one obstacle detection sensor and a drive motor. The control system is configured to receive an obstacle detection signal, and generate a corresponding drive control signal in response to the obstacle detection signal and transmit the corresponding drive control signal to the drive motor, to control movement of the self-moving robot on the to-be-cleaned plane. The wet cleaning apparatus includes at least one cleaning head. The cleaning head performs a reciprocating motion along the to-be-cleaned surface.

In an implementation, the wet cleaning apparatus includes a water supply mechanism, a water return mechanism, and a water tank. The water tank includes a clean water tank and a dirty water tank. The clean water tank is connected to the water supply mechanism to supply clean water in the clean water tank to the cleaning head through the water supply mechanism, thereby improving a cleaning effect of the cleaning head. The water return mechanism sends dirty water on the surface cleaned by the cleaning head back to the dirty water tank.

In an implementation, a dynamic adjustment water pump is disposed in each of the water supply mechanism and the water return mechanism, to dynamically adjust the power of the water pump as external pressure or the water amount of the water tank changes.

In an implementation, a garbage recovery apparatus is disposed in the water return mechanism, to collect insoluble garbage brought back by the water return mechanism.

In an implementation, a water amount detection module is disposed in the water tank.

In an implementation, the wet cleaning apparatus includes a lifting module, to control the suspension height of the wet cleaning apparatus. In an implementation, a guide wheel is disposed in front of the wet cleaning apparatus, to reduce advance resistance of the wet cleaning apparatus.

In conclusion, the detachable structure provided in the present disclosure includes the pressure plate, the pressure plate has the connection end and the movable end, the connection end is connected to the housing, and the movable end is adjustably clamped to the housing. Accordingly, when the movable end and the housing are in a clamped state, the movable end blocks a partial structure of the cleaning assembly to enable the cleaning assembly to abut against the housing. When the movable end and the housing are in a non-clamped state, the cleaning assembly is removable from the housing. According to the foregoing design, the detachable structure provided in the present disclosure can implement quick and convenient disassembly/assembly of functional structures of the self-moving robot, so that the user can detach, clean, and replace the cleaning assembly more conveniently by using the detachable structure. In addition, the detachable structure facilitates later maintenance and repair of the self-moving robot.

In conclusion, the drive wheel module provided in the present disclosure is applicable to the self-moving robot, and includes the body portion, the drive wheel, and the drive motor.

The body portion is disposed in the rack of the self-moving robot. The drive wheel is disposed in the body portion. The drive motor is disposed in the body portion and in transmission connection with the drive wheel. The drive motor is located on the outer side of the drive wheel relative to the middle of the rack. According to the foregoing design, in the drive wheel module provided in the present disclosure, the drive motor is disposed outside the drive wheel without being affected by the space of other functional structures disposed in the middle of the rack of the self-moving robot. Therefore, the drive motor and the drive wheel can be arranged more conveniently and reasonably, and relatively large space can be left between the drive motor and the drive wheel, to facilitate installation, maintenance, and replacement of the drive wheel and the drive motor while facilitating arrangement of other structures such as the transmission assembly.

Furthermore, the self-moving robot provided in the present disclosure changes, by using a novel design of a mopping structure, a case that a general self-moving robot can perform only dry cleaning or wet cleaning, and changes, by using a mechanical reciprocating mopping structure, a current situation that a general wet self-moving robot can perform only simple ground cleaning, thereby improving a cleaning effect and further optimizing a structural design of the self-moving robot on this basis.

According to an aspect of the present disclosure, a detachable structure is provided. The detachable structure is provided in a self-moving robot. The self-moving robot includes a wet cleaning apparatus. The wet cleaning apparatus includes a housing and a cleaning assembly disposed in the housing. The detachable structure includes a pressure plate. The pressure plate has a connection end and a movable end. The movable end is adjustably clamped to the housing. When the movable end and the housing are in a clamped state, the movable end blocks a partial structure of the cleaning assembly to enable the cleaning assembly to abut against the housing. When the movable end and the housing are in a non-clamped state, the cleaning assembly is removable from the housing.

According to one implementation of the present disclosure, the cleaning assembly includes a cleaning head and a water supply mechanism, and the water supply mechanism is configured to supply clean water to the cleaning head.

According to one implementation of the present disclosure, the cleaning assembly further includes a water return mechanism, and the water return mechanism is configured to collect dirty water generated during cleaning.

According to one implementation of the present disclosure, the connection end is connected to the housing.

According to one implementation of the present disclosure, the connection end is pivoted to the housing through a pivot shaft.

According to one implementation of the present disclosure, a first pivot hole is disposed in the connection end, the housing has a pivoting structure, second pivot holes are respectively disposed at positions of the pivoting structure corresponding to two sides of the connection end, and the pivot shaft passes through the first pivot hole and the second pivot holes to pivot the connection end to the housing.

According to one implementation of the present disclosure, a first clamping structure is disposed on the movable end, a second clamping structure is disposed on a position of the housing corresponding to the movable end, and the first clamping structure is engaged with the second clamping structure through clamping.

According to one implementation of the present disclosure, the housing is defined with accommodation space for accommodating the cleaning head, the cleaning head is provided with two connection end portions opposite to each other, a connection end portion is detachably connected to an end of the accommodation space, the other connection end portion is located at the other end of the accommodation space, wherein the movable end is adjustably clamped to the other end of the accommodation space, and when the movable end and the housing are in the clamped state, the other connection end portion of the cleaning head is pressed against and positioned on the other end of the accommodation space by the pressure plate; and/or, the housing is defined with accommodation space for accommodating the water return mechanism, the water return mechanism is provided with two connection end portions opposite to each other, a connection end portion is detachably connected to an end of the accommodation space, the other connection end portion is located at the other end of the accommodation space, wherein the movable end is adjustably clamped to the other end of the accommodation space, and when the movable end and the housing are in the clamped state, the other connection end portion of the water return mechanism is pressed against and positioned on the other end of the accommodation space by the pressure plate.

According to another aspect of the present disclosure, a self-moving robot is provided. The self-moving robot includes the detachable structure provided in the present disclosure and described in the foregoing implementations.

According to one implementation of the present disclosure, the self-moving robot includes a rack and a drive wheel module. The drive wheel module includes a body portion, a drive wheel, and a drive motor. One end of the body portion is connected to the rack. The drive wheel is disposed in the body portion. The drive motor is disposed in the body portion and is in transmission connection with the drive wheel to rotate the drive wheel.

According to one implementation of the present disclosure, the drive motor is located on an outer side of the drive wheel relative to the middle of the rack.

According to one implementation of the present disclosure, the axis of the drive motor is located within a projected area of the drive wheel.

According to one implementation of the present disclosure, the drive wheel has an axle, and the axis of the drive motor and the axle are located on the same axis.

According to one implementation of the present disclosure, the drive wheel is disposed on an inner side of the body portion relative to the middle of the rack, an accommodation part is disposed on the inner side of the body portion relative to the middle of the rack, and the drive wheel is partially accommodated in the accommodation part.

According to one implementation of the present disclosure, one end of the body portion is connected to the rack, and the drive wheel module further includes an elastic element. The elastic element is extended and arranged on a vertical plane and has an upper end and a lower end. The lower end is connected to the body portion, the upper end is connected to the rack, and the elastic element is configured to provide an elastic force between the rack and the body portion.

According to one implementation of the present disclosure, a connection position of the elastic element and the body portion is between the one end of the body portion and the drive wheel.

According to one implementation of the present disclosure, a groove is disposed on the top of the body portion, and the lower end of the elastic element is disposed in the groove.

According to one implementation of the present disclosure, the elastic element is inclined to the one end of the body portion in the direction from the body portion to the rack.

According to one implementation of the present disclosure, the self-moving robot includes at least one pair of drive wheel modules, and the two drive wheel modules of the same pair are symmetrically arranged relative to the rack.

According to one implementation of the present disclosure, the self-moving robot includes a dry cleaning apparatus. The dry cleaning apparatus is disposed at the bottom of the rack. The two drive wheel modules of the same pair are respectively located at two ends of the dry cleaning apparatus.

It can be learned from the foregoing technical solutions that, the detachable structure provided in the present disclosure includes the pressure plate, the pressure plate has the connection end and the movable end, the connection end is connected to the housing, and the movable end is adjustably clamped to the housing. Accordingly, when the movable end and the housing are in a clamped state, the movable end blocks a partial structure of the cleaning assembly to enable the cleaning assembly to abut against the housing. When the movable end and the housing are in a non-clamped state, the cleaning assembly is removable from the housing. According to the foregoing design, the detachable structure provided in the present disclosure can implement quick and convenient disassembly/assembly of functional structures of the self-moving robot, so that the user can detach, clean, and replace the cleaning assembly more conveniently by using the detachable structure. In addition, the detachable structure facilitates later maintenance and repair of the self-moving robot.

A main objective of the present disclosure is to provide a drive wheel module having a reasonably arranged structure and applicable to a self-moving robot, to overcome at least one disadvantage of the foregoing prior art.

Another main objective of the present disclosure is to provide a self-moving robot having the foregoing drive wheel module, to overcome at least one disadvantage of the foregoing prior art.

To implement the foregoing objectives, the present disclosure uses the following technical solutions:

According to an aspect of the present disclosure, a drive wheel module is provided. The drive wheel module is disposed in a self-moving robot. The self-moving robot includes a rack. The drive wheel module includes a body portion, a drive wheel, and a drive motor. One end of the body portion is connected to the rack. The drive wheel is disposed in the body portion. The drive motor is disposed in the body portion and is in transmission connection with the drive wheel to rotate the drive wheel. The drive motor is located on an outer side of the drive wheel relative to the middle of the rack.

According to one implementation of the present disclosure, the axis of the drive motor is located within a projected area of the drive wheel.

According to one implementation of the present disclosure, the drive wheel has an axle, and the axis of the drive motor and the axle are located on the same axis.

According to one implementation of the present disclosure, the drive wheel is in transmission connection with the drive motor through a transmission assembly, and the transmission assembly includes at least one of a decelerator and a transmission gear set.

According to one implementation of the present disclosure, the drive wheel is disposed on an inner side of the body portion relative to the middle of the rack.

According to one implementation of the present disclosure, an accommodation part is disposed on the inner side of the body portion relative to the middle of the rack, and the drive wheel is partially accommodated in the accommodation part.

According to one implementation of the present disclosure, one end of the body portion is connected to the rack, and the drive wheel module further includes an elastic element. The elastic element is extended and arranged on a vertical plane and has an upper end and a lower end. The lower end is connected to the body portion, the upper end is connected to the rack, and the elastic element is configured to provide an elastic force between the rack and the body portion. When the self-moving robot is placed on the ground, the elastic element is in a compressed state due to a pressing force generated by the weight of the self-moving robot.

According to one implementation of the present disclosure, a connection position of the elastic element and the body portion is between the one end of the body portion and the drive wheel.

According to one implementation of the present disclosure, a groove is disposed on the top of the body portion, and the lower end of the elastic element is disposed in the groove.

According to one implementation of the present disclosure, the elastic element is inclined to the one end of the body portion in the direction from the body portion to the rack.

According to one implementation of the present disclosure, the elastic element includes a spring, a spring plate, or a leaf spring.

According to another aspect of the present disclosure, a self-moving robot is provided. The self-moving robot includes the drive wheel module provided in the present disclosure and described in the foregoing implementations.

According to one implementation of the present disclosure, the self-moving robot includes at least one pair of drive wheel modules, and the two drive wheel modules of the same pair are symmetrically arranged relative to the rack.

According to one implementation of the present disclosure, the self-moving robot includes a dry cleaning apparatus. The dry cleaning apparatus is disposed at the bottom of the rack. The two drive wheel modules of the same pair are respectively located at two ends of the dry cleaning apparatus.

According to one implementation of the present disclosure, the self-moving robot further includes a wet cleaning apparatus. The wet cleaning apparatus includes a housing and a cleaning assembly disposed in the housing. The self-moving robot further includes a detachable structure. The detachable structure includes a pressure plate. The pressure plate has a connection end and a movable end. The movable end is adjustably clamped to the housing. When the movable end and the housing are in a clamped state, the movable end blocks a partial structure of the cleaning assembly to enable the cleaning assembly to abut against the housing. When the movable end and the housing are in a non-clamped state, the cleaning assembly is removable from the housing.

According to one implementation of the present disclosure, the connection end is connected to the housing.

According to one implementation of the present disclosure, the connection end is pivoted to the housing through a pivot shaft.

According to one implementation of the present disclosure, a first pivot hole is disposed in the connection end, the housing has a pivoting structure, second pivot holes are respectively disposed at positions of the pivoting structure corresponding to two sides of the connection end, and the pivot shaft passes through the first pivot hole and the second pivot holes to pivot the connection end to the housing.

According to one implementation of the present disclosure, a first clamping structure is disposed on the movable end, a second clamping structure is disposed on a position of the housing corresponding to the movable end, and the first clamping structure is engaged with the second clamping structure through clamping.

According to one implementation of the present disclosure, the housing is defined with accommodation space for accommodating the cleaning head, the cleaning head is provided with two connection end portions opposite to each other, a connection end portion is detachably connected to an end of the accommodation space, the other connection end portion is located at the other end of the accommodation space, wherein the movable end is adjustably clamped to the other end of the accommodation space, and when the movable end and the housing are in the clamped state, the other connection end portion of the cleaning head is pressed against and positioned on the other end of the accommodation space by the pressure plate; and/or, the housing is defined with accommodation space for accommodating the water return mechanism, the water return mechanism is provided with two connection end portions opposite to each other, a connection end portion is detachably connected to an end of the accommodation space, the other connection end portion is located at the other end of the accommodation space, wherein the movable end is adjustably clamped to the other end of the accommodation space, and when the movable end and the housing are in the clamped state, the other connection end portion of the water return mechanism is pressed against and positioned on the other end of the accommodation space by the pressure plate.

It can be learned from the foregoing technical solutions that, the drive wheel module provided in the present disclosure is applicable to the self-moving robot, and includes the body portion, the drive wheel, and the drive motor. One end of the body portion is connected to the rack of the self-moving robot. The drive wheel is disposed in the body portion. The drive motor is disposed in the body portion and in transmission connection with the drive wheel. The drive motor is located on the outer side of the drive wheel relative to the middle of the rack. According to the foregoing design, in the drive wheel module provided in the present disclosure, the drive motor is disposed outside the drive wheel without being affected by the space of other functional structures disposed in the middle of the rack of the self-moving robot. Therefore, the drive motor and the drive wheel can be arranged more conveniently and reasonably, and relatively large space can be left between the drive motor and the drive wheel, to facilitate installation, maintenance, and replacement of the drive wheel and the drive motor while facilitating arrangement of other structures such as the transmission assembly.

A main objective of the present disclosure is to provide a drive wheel module that can ensure effective driving, has good passability, and is applicable to a self-moving robot, to overcome at least one disadvantage of the foregoing prior art.

Another main objective of the present disclosure is to provide a self-moving robot having the foregoing drive wheel module, to overcome at least one disadvantage of the foregoing prior art.

To implement the foregoing objectives, the present disclosure uses the following technical solutions:

According to an aspect of the present disclosure, a drive wheel module is provided. The drive wheel module is disposed in a self-moving robot. The self-moving robot includes a rack. The drive wheel module includes a body portion, a drive wheel, and an elastic element. One end of the body portion is connected to the rack. The drive wheel is disposed in the body portion and is driven by a drive motor. The elastic element is extended and arranged on a vertical plane and has an upper end and a lower end. The lower end is connected to the body portion, the upper end is connected to the rack, and the elastic element is configured to provide an elastic force between the rack and the body portion. When the self-moving robot is placed on the ground, the elastic element is in a compressed state due to a pressing force generated by the weight of the self-moving robot.

According to one implementation of the present disclosure, a connection position of the elastic element and the body portion is between the one end of the body portion and the drive wheel.

According to one implementation of the present disclosure, a groove is disposed on the top of the body portion, and the lower end of the elastic element is disposed in the groove.

According to one implementation of the present disclosure, the elastic element is inclined to the one end of the body portion in the direction from the body portion to the rack.

According to one implementation of the present disclosure, the elastic element includes a spring, a spring plate, or a leaf spring.

According to one implementation of the present disclosure, the drive wheel is disposed on an inner side of the body portion relative to the middle of the rack.

According to one implementation of the present disclosure, an accommodation part is disposed on the inner side of the body portion relative to the middle of the rack, and the drive wheel is partially accommodated in the accommodation part.

According to one implementation of the present disclosure, the drive motor is disposed in the body portion and is in transmission connection with the drive wheel, and the drive motor is located on an outer side of the drive wheel relative to the middle of the rack.

According to one implementation of the present disclosure, the axis of the drive motor is located within a projected area of the drive wheel.

According to one implementation of the present disclosure, the drive wheel has an axle, and the axis of the drive motor and the axle are located on the same axis.

According to one implementation of the present disclosure, the drive wheel is in transmission connection with the drive motor through a transmission assembly, and the transmission assembly includes at least one of a decelerator and a transmission gear set.

According to another aspect of the present disclosure, a self-moving robot is provided. The self-moving robot includes the drive wheel module provided in the present disclosure and described in the foregoing implementations.

According to one implementation of the present disclosure, the self-moving robot includes at least one pair of drive wheel modules, and the two drive wheel modules of the same pair are symmetrically arranged relative to the rack.

According to one implementation of the present disclosure, the self-moving robot includes a dry cleaning apparatus. The dry cleaning apparatus is disposed at the bottom of the rack. The two drive wheel modules of the same pair are respectively located at two ends of the dry cleaning apparatus.

According to one implementation of the present disclosure, the self-moving robot further includes a wet cleaning apparatus. The wet cleaning apparatus includes a housing and a cleaning assembly disposed in the housing. The self-moving robot further includes a detachable structure. The detachable structure includes a pressure plate. The pressure plate has a connection end and a movable end. The movable end is adjustably clamped to the housing. When the movable end and the housing are in a clamped state, the movable end blocks a partial structure of the cleaning assembly to enable the cleaning assembly to abut against the housing. When the movable end and the housing are in a non-clamped state, the cleaning assembly is removable from the housing.

According to one implementation of the present disclosure, the connection end is connected to the housing.

According to one implementation of the present disclosure, the connection end is pivoted to the housing through a pivot shaft.

According to one implementation of the present disclosure, a first pivot hole is disposed in the connection end, the housing has a pivoting structure, second pivot holes are respectively disposed at positions of the pivoting structure corresponding to two sides of the connection end, and the pivot shaft passes through the first pivot hole and the second pivot holes to pivot the connection end to the housing.

According to one implementation of the present disclosure, a first clamping structure is disposed on the movable end, a second clamping structure is disposed on a position of the housing corresponding to the movable end, and the first clamping structure is engaged with the second clamping structure through clamping.

According to one implementation of the present disclosure, the housing is defined with accommodation space for accommodating the cleaning head, the cleaning head is provided with two connection end portions opposite to each other, a connection end portion is detachably connected to an end of the accommodation space, the other connection end portion is located at the other end of the accommodation space, wherein the movable end is adjustably clamped to the other end of the accommodation space, and when the movable end and the housing are in the clamped state, the other connection end portion of the cleaning head is pressed against and positioned on the other end of the accommodation space by the pressure plate; and/or, the housing is defined with accommodation space for accommodating the water return mechanism, the water return mechanism is provided with two connection end portions opposite to each other, a connection end portion is detachably connected to an end of the accommodation space, the other connection end portion is located at the other end of the accommodation space, wherein the movable end is adjustably clamped to the other end of the accommodation space, and when the movable end and the housing are in the clamped state, the other connection end portion of the water return mechanism is pressed against and positioned on the other end of the accommodation space by the pressure plate.

It can be learned from the foregoing technical solutions that, the drive wheel module provided in the present disclosure is applicable to the self-moving robot, and includes the body portion, the drive wheel, and the elastic element. One end of the body portion is connected to the rack. The drive wheel is disposed in the body portion and is driven by the drive motor. The elastic element is extended and arranged on the vertical plane, with the upper end and the lower end respectively connected to the body portion and the rack, and the elastic element can provide the elastic force between the rack and the body portion. According to the foregoing design, the drive wheel module provided in the present disclosure provides a downward elastic force between the rack and the body portion through the elastic element, to provide a certain grounding force for the drive wheel module to maintain contact and traction with the ground, and provide cushioning and shock absorption functions for the drive wheel module during walking of the self-moving robot, so that the drive wheel module disposed with the elastic element forms an offset drop suspension system, thereby ensuring effective driving and good passability of the drive wheel module.

Although the present disclosure has been described with reference to several typical embodiments, it should be understood that the used terms are illustrative and exemplary rather than limitative. Because the present disclosure can be specifically implemented in various forms without departing from the spirit or substance of the disclosure, it should be understood that the foregoing embodiments are not limited to any of the foregoing details and should be broadly interpreted within the spirit and scope defined by the appended claims. Therefore, all changes and modifications falling within the scope of the claims or their equivalents should be included in the appended claims.

What is claimed is:

1. A detachable structure, provided in a self-moving robot, wherein the self-moving robot comprises a wet cleaning apparatus, the wet cleaning apparatus comprises a housing and a cleaning assembly disposed in the housing, and the detachable structure comprises:

a pressure plate, having a connection end and a movable end, the movable end being adjustably clamped to the housing, wherein:

when the movable end and the housing are in a clamped state, the movable end blocks a partial structure of the cleaning assembly such that the cleaning assembly abuts against the housing; and when the movable end and the housing are in a non-clamped state, the cleaning assembly is removable from the housing;

wherein the cleaning assembly comprises a water return mechanism, the water return mechanism is configured to recover dirty water generated during cleaning, wherein the water return mechanism comprises a water suction roller and a recovery rod, the water suction roller is sleeved with a water suction material, and the recovery rod is provided with a scraping strip configured to squeeze the water suction material on the water suction roller.

2. The detachable structure according to claim 1, wherein the cleaning assembly comprises a cleaning head and a water supply mechanism, and the water supply mechanism is configured to supply clean water to the cleaning head.

3. The detachable structure according to claim 1, wherein the connection end is connected to the housing.

4. The detachable structure according to claim 3, wherein the connection end is pivoted to the housing through a pivot shaft.

5. The detachable structure according to claim 4, wherein the connection end is defined with a first pivot hole, the housing is provided with a pivoting structure, the pivoting structure is defined with second pivot holes at positions respectively corresponding to two sides of the connection end, and the pivot shaft passes through the first pivot hole and the second pivot holes to pivot the connection end to the housing.

6. The detachable structure according to claim 1, wherein the movable end is provided with a first clamping structure, the housing is provided with a second clamping structure on a position corresponding to the movable end, and the first clamping structure is engaged with the second clamping structure.

7. The detachable structure according to claim 6, wherein the first clamping structure and the second clamping structure are in one of the following structures:

a male clamping head and a female clamping head, clamping tenons mutually matched, and a clamping post and a clamping hole.

8. The detachable structure according to claim 1, wherein the housing is defined with a first accommodation space for accommodating a cleaning head of the cleaning assembly, the cleaning head is provided with a first connection end portion and a second connection end portion opposite to each other, the first connection end portion of the cleaning head is detachably connected to a first end of the first accommodation space, the second connection end portion of the cleaning head is located at a second end of the first accommodation space, wherein the movable end is adjustably clamped to the second end of the first accommodation space, and when the movable end and the housing are in the clamped state, the second connection end portion of the cleaning head is pressed against and positioned on the second end of the first accommodation space by the pressure plate.

9. The detachable structure according to claim 1, wherein the housing is defined with a second accommodation space for accommodating the water return mechanism, the water return mechanism is provided with a first connection end portion and a second connection end portion opposite to each other, the first connection end portion of the water return mechanism is detachably connected to a first end of the second accommodation space, the second connection end portion of the water return mechanism is located at a second end of the second accommodation space, wherein the movable end is adjustably clamped to the second end of the second accommodation space, and when the movable end and the housing are in the clamped state, the second connection end portion of the water return mechanism is pressed against and positioned on the second end of the second accommodation space by the pressure plate.

10. The detachable structure according to claim 1, wherein the housing is defined with a first accommodation space for accommodating a cleaning head of the cleaning assembly, the cleaning head is provided with a first connection end portion and a second connection end portion opposite to each other, the first connection end portion of the cleaning head is detachably connected to a first end of the first accommodation space, the second connection end portion of the cleaning head is located at a second end of the first accommodation space, wherein the movable end is adjustably clamped to the second end of the first accommodation space, and when the movable end and the housing are in the clamped state, the second connection end portion of the cleaning head is pressed against and positioned on the second end of the first accommodation space by the pressure plate; and the housing is defined with a second accommodation space for accommodating the water return mechanism, the water return mechanism is provided with a first connection end portion and a second connection end portion opposite to each other, the first connection end portion of the water return mechanism is detachably connected to a first end of the second accommodation space, the second connection end portion of the water return mechanism is located at a second end of the second accommodation space, wherein the movable end is adjustably clamped to the second end of the second accommodation space, and when the movable end and the housing are in the clamped state, the second connection end portion of the water return mechanism is pressed against and positioned on the second end of the second accommodation space by the pressure plate.

11. A self-moving robot comprising a detachable structure, wherein the detachable structure is provided in a self-moving robot, wherein the self-moving robot comprises a wet cleaning apparatus, the wet cleaning apparatus comprises a housing and a cleaning assembly disposed in the housing, and the detachable structure comprises:

a pressure plate, having a connection end and a movable end, the movable end being adjustably clamped to the housing, wherein when the movable end and the housing are in a clamped state, the movable end blocks a partial structure of the cleaning assembly such that the cleaning assembly abuts against the housing;

when the movable end and the housing are in a non-clamped state, the cleaning assembly is removable from the housing;

wherein the cleaning assembly comprises a water return mechanism, the water return mechanism is configured to recover dirty water generated during cleaning, wherein the water return mechanism comprises a water suction roller and a recovery rod, the water suction roller is sleeved with a water suction material, and the recovery rod is provided with a scraping strip configured to squeeze the water suction material on the water suction roller.

12. The self-moving robot according to claim 11, wherein the self-moving robot comprises a rack and a drive wheel module, the drive wheel module comprises:

a body portion with an end connected to the rack;

a drive wheel, disposed in the body portion; and a drive motor, disposed in the body portion and in transmission connection with the drive wheel to rotate the drive wheel.

13. The self-moving robot according to claim 12, wherein the drive wheel module further comprises an elastic element arranged along a vertical plane, and the elastic element has an upper end connected to the rack and a lower end connected to the body portion.

14. The self-moving robot according to claim 11, wherein the cleaning assembly comprises a cleaning head and a water supply mechanism, and the water supply mechanism is configured to supply clean water to the cleaning head.

15. The self-moving robot according to claim 11, wherein the connection end is connected to the housing.

16. The self-moving robot according to claim 15, wherein the connection end is pivoted to the housing through a pivot shaft.

17. The self-moving robot according to claim 16, wherein the connection end is defined with a first pivot hole, the housing is provided with a pivoting structure, the pivoting structure is defined with second pivot holes at positions respectively corresponding to two sides of the connection end, and the pivot shaft passes through the first pivot hole and the second pivot holes to pivot the connection end to the housing.

18. The self-moving robot according to claim 11, wherein the movable end is provided with a first clamping structure, the housing is provided with a second clamping structure on a position corresponding to the movable end, and the first clamping structure is engaged with the second clamping structure.

* * * * *